US010934607B2

(12) United States Patent
Nakamura et al.

(10) Patent No.: US 10,934,607 B2
(45) Date of Patent: Mar. 2, 2021

(54) TITANIUM SINTERED BODY, ORNAMENT, AND HEAT RESISTANT COMPONENT

(71) Applicant: Seiko Epson Corporation, Tokyo (JP)

(72) Inventors: Hidefumi Nakamura, Hachinohe (JP); Taku Kawasaki, Hachinohe (JP)

(73) Assignee: Seiko Epson Corporation

( * ) Notice: Subject to any disclaimer, the term of this patent is extended or adjusted under 35 U.S.C. 154(b) by 285 days.

(21) Appl. No.: 15/471,292

(22) Filed: Mar. 28, 2017

(65) Prior Publication Data

US 2017/0283912 A1 Oct. 5, 2017

(30) Foreign Application Priority Data

Mar. 29, 2016 (JP) ..... JP2016-065883
May 30, 2016 (JP) ..... JP2016-107642
Nov. 21, 2016 (JP) ..... JP2016-226041

(51) Int. Cl.
*C22C 14/00* (2006.01)
*B22F 5/00* (2006.01)

(52) U.S. Cl.
CPC ..... *C22C 14/00* (2013.01); *B22F 5/00* (2013.01); *B22F 2301/205* (2013.01)

(58) Field of Classification Search
None
See application file for complete search history.

(56) References Cited

U.S. PATENT DOCUMENTS 4,810,465 A * 3/1989 Kimura ..... C22C 14/00 420/417
5,672,936 A * 9/1997 Hatsutori ..... H01J 61/28 313/352
2005/0163646 A1* 7/2005 Li ..... B22F 3/14 419/32

(Continued)

FOREIGN PATENT DOCUMENTS

JP S56-25946 * 3/1981
JP H07-062466 A 3/1995

(Continued)

OTHER PUBLICATIONS

English machine translation of JP2012-007223, JPO, accessed Apr. 10, 2018.*

(Continued)

*Primary Examiner* — Xiaobei Wang
(74) *Attorney, Agent, or Firm* — Harness, Dickey & Pierce, P.L.C.

(57) ABSTRACT

A titanium sintered body is composed of a material containing titanium, and has an oxygen content of 2500 ppm by mass or more and 5500 ppm by mass or less and a surface Vickers hardness of 250 or more and 500 or less. It is preferred that an α-phase and a β-phase are contained as crystal structures, and an area ratio occupied by the α-phase in a cross section is 70% or more and 99.8% or less. It is also preferred that in an X-ray diffraction spectrum obtained by X-ray diffractometry, the value of a peak reflection intensity by the plane orientation (110) of the β-phase is 5% or more (Continued)

and 60% or less of the value of a peak reflection intensity by the plane orientation (100) of the α-phase. It is also preferred that particles composed mainly of titanium oxide are included.

9 Claims, 9 Drawing Sheets

(56) References Cited

U.S. PATENT DOCUMENTS

| | | | | |
|---|---|---|---|---|
| 2013/0071283 | A1* | 3/2013 | Kano | B22F 8/00 419/10 |
| 2013/0177468 | A1* | 7/2013 | Hayashi | A61C 8/0075 419/6 |
| 2013/0183188 | A1* | 7/2013 | Tofail | C22C 1/04 419/28 |
| 2014/0255240 | A1* | 9/2014 | Fang | B22F 3/101 419/29 |
| 2014/0377119 | A1* | 12/2014 | Abkowitz | C22C 1/0458 419/23 |
| 2017/0160035 | A1* | 6/2017 | Piemme | F41A 21/30 |

FOREIGN PATENT DOCUMENTS

| | | | |
|---|---|---|---|
| JP | H07-090432 | A | 4/1995 |
| JP | H07-289566 | A | 11/1995 |
| JP | H11-172362 | A | 6/1999 |
| JP | 2002-105577 | A | 4/2002 |
| JP | 2006-131950 | A | 5/2006 |
| JP | 2012-007223 | * | 1/2012 |
| JP | 2012-241241 | * | 12/2012 |

OTHER PUBLICATIONS

English machine translation of JP2012-241241, EPO, accessed Apr. 10, 2018.*

Heanjia, "Application of Titanium for automobile components", Oct. 9, 2015, https://super-metals.com/applications/application-of-titanium-for-automobile-components/, accessed Mar. 4, 2019. (Year: 2015).*

Takashi Nishimura, "Titanium and Its Alloys for Aerospace", 20th Aircraft Symposium Speech, Kobe Steel Ltd, Central Laboratory, Kobe-shi, Japan, Dec. 14, 1983, 14 pages, with English translation.

* cited by examiner

TITANIUM SINTERED BODY, ORNAMENT, AND HEAT RESISTANT COMPONENT

CROSS-REFERENCE TO RELATED APPLICATIONS

This application claims priority to Japanese Patent Application No. 2016-065883 filed on Mar. 29, 2016, No. 2016-107642 filed on May 30, 2016 and No. 2016-226041 filed on Nov. 21, 2016. The entire disclosures of Japanese Patent Application No. 2016-065883, No. 2016-107642 and No. 2016-226041 are hereby incorporated herein by reference.

BACKGROUND

1. Technical Field

The present invention relates to a titanium sintered body, an ornament, and a heat resistant component.

2. Related Art

A titanium alloy has a high mechanical strength and excellent corrosion resistance, and therefore has been used in the fields of aircraft, space development, chemical plants, and the like. Further, recently, by utilizing the characteristics such as biocompatibility, a low Young's modulus, and a lightweight of a titanium alloy, a titanium alloy has begun to be applied to exterior components of watches, ornaments such as glasses frames, sporting goods such as golf clubs, springs, and the like.

Further, in the application of a titanium alloy in this manner, by using a powder metallurgy method, a titanium sintered body having a shape close to the final shape can be easily produced. Therefore, secondary processing can be omitted or a processing amount can be reduced, and thus, components can be efficiently produced.

However, a titanium sintered body produced by a powder metallurgy method has low wear resistance. Therefore, in the case where a titanium sintered body is applied to a sliding component, wear occurs as a result of sliding, and the component adheres to a counter member.

Therefore, JP-A-2006-131950 (Patent Document 1) has proposed an Fe—Ti sintered member, which is composed of an Fe—Ti phase containing Ti in amount of 30 to 80 mass %, a soft metallic phase having corrosion resistance, and pores, and exhibits a metallic structure in which the Fe—Ti phase and the soft metallic phase are patchily dispersed, and in which the ratio of the soft metallic phase to the entire structure is from 5 to 20 vol %, and the density ratio is 90% or more. Then, it is disclosed that such an Fe—Ti sintered member is favorable as a sliding member for machines, automobiles, etc.

However, the Fe—Ti sintered member described in Patent Document 1 contains Fe at a relatively high concentration, and therefore has lower corrosion resistance and a larger mass than pure titanium or a titanium alloy containing titanium in an amount exceeding 80%. Moreover, the Fe—Ti sintered member described in Patent Document 1 includes pores, and therefore has a large frictional resistance, and therefore has low wear resistance. In addition, the Fe—Ti sintered member contains Fe at a relatively high concentration, and therefore has a lower mechanical strength than a titanium alloy.

SUMMARY

An advantage of some aspects of the invention is to provide a titanium sintered body, an ornament, and a heat resistant component each having excellent wear resistance.

The advantage can be achieved by the configurations described below.

A titanium sintered body according to an aspect of the invention is composed of a material containing titanium, and has an oxygen content of 2500 ppm by mass or more and 5500 ppm by mass or less and a surface Vickers hardness is 250 or more and 500 or less.

According to this configuration, the corrosion resistance of a sliding surface is increased, and also the frictional resistance of a sliding surface is decreased, and therefore, a titanium sintered body having excellent wear resistance is obtained.

In the titanium sintered body according to the aspect of the invention, it is preferred that an α-phase and a β-phase are contained as crystal structures, and an area ratio occupied by the α-phase in a cross section is 70% or more and 99.8% or less.

According to this configuration, while increasing the mechanical strength of the titanium sintered body, the sintered body is likely to be homogeneous as a whole, and therefore, the uniformity of wear susceptibility can also be increased. Due to this, when the titanium sintered body is applied to a sliding component, a phenomenon of continuous acceleration of wear caused by local occurrence of a region which is likely to wear out in a sliding surface is suppressed, and therefore, a titanium sintered body having higher wear resistance is obtained.

In the titanium sintered body according to the aspect of the invention, it is preferred that in an X-ray diffraction spectrum obtained by X-ray diffractometry, the value of a peak reflection intensity by the plane orientation (110) of the β-phase is 5% or more and 60% or less of the value of a peak reflection intensity by the plane orientation (100) of the α-phase.

According to this configuration, the characteristics of the α-phase and the characteristics of the β-phase become obvious without being hidden. As a result, a titanium sintered body capable of maintaining excellent wear resistance particularly for a long period of time is obtained.

In the titanium sintered body according to the aspect of the invention, it is preferred that particles composed mainly of titanium oxide are included.

According to this configuration, the particles composed mainly of titanium oxide are dispersed in the titanium sintered body, and stress applied to metallic titanium which is a matrix can be shared. Due to this, by including the particles, the mechanical strength of the titanium sintered body is improved as a whole.

In the titanium sintered body according to the aspect of the invention, it is preferred that a relative density is 99% or more.

According to this configuration, it becomes difficult to expose pores on a sliding surface, and therefore, it becomes difficult to cause wear starting from the pores, resulting in decreasing the frictional resistance, and thus, a titanium sintered body showing particularly favorable wear resistance is obtained.

An ornament according to an aspect of the invention includes the titanium sintered body according the aspect of the invention.

According to this configuration, excellent wear resistance is imparted to the surface, and also scratching or wear is suppressed, and thus, an ornament capable of maintaining excellent aesthetic appearance for a long period of time is obtained.

A heat resistant component according to an aspect of the invention includes the titanium sintered body according the aspect of the invention.

According to this configuration, a heat resistant component having excellent wear resistance and heat resistance is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
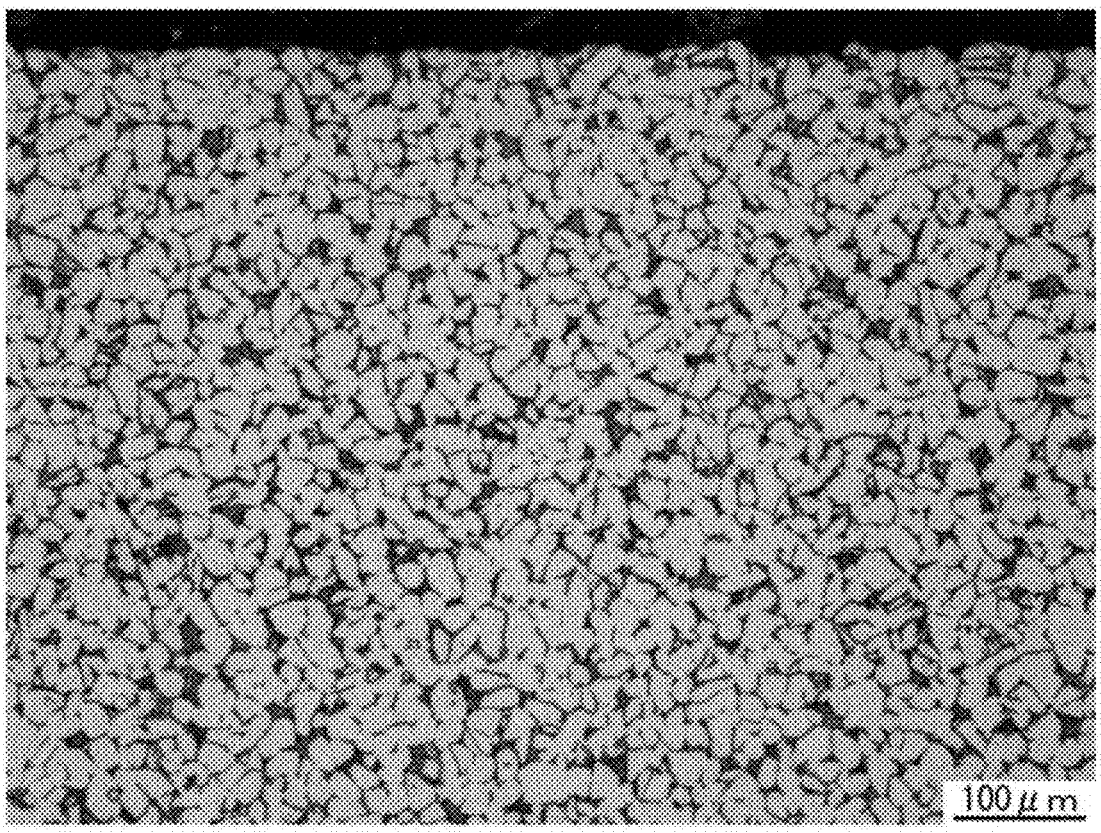
FIG. 1 is an electron microscopic image showing an embodiment of a titanium sintered body according to the invention.

Hereinafter, a titanium sintered body, an ornament, and a heat resistant component according to the invention will be described in detail with reference to preferred embodiments shown in the accompanying drawings.

Titanium Sintered Body

First, an embodiment of the titanium sintered body according to the invention will be described.

The titanium sintered body according to this embodiment is produced by, for example, a powder metallurgy method. Therefore, this titanium sintered body is formed by sintering particles of a titanium-based powder (a powder constituted by a material containing titanium) to one another.

The titanium sintered body according to this embodiment is constituted by a material containing titanium, and has an oxygen content of 2500 ppm by mass or more and 5500 ppm by mass or less and a surface Vickers hardness of 250 or more and 500 or less. Such a titanium sintered body has excellent wear resistance. Due to this, a titanium sintered body capable of maintaining favorable sliding properties for a long period of time even under severe sliding conditions when it is applied to, for example, a sliding component is obtained. Further, a titanium sintered body capable of maintaining excellent aesthetic appearance by imparting excellent wear resistance to the surface so as to suppress scratching of the surface when it is applied to, for example, an ornament is obtained.

When the oxygen content is less than the above lower limit, titanium oxide in the titanium sintered body is significantly decreased. Titanium oxide has a function to increase the corrosion resistance of the titanium sintered body and make the titanium sintered body less likely to wear out. Due to this, when the oxygen content is less than the above lower limit, titanium oxide is particularly decreased, and accompanying this, the corrosion resistance is decreased, and therefore, wear resistance is decreased. On the other hand, when the oxygen content exceeds the above upper limit, titanium oxide in the titanium sintered body is significantly increased. Due to this, the proportion of a metal bond between metallic titanium atoms is decreased, and the mechanical strength is decreased. Due to this, for example, peeling, cracking, or the like is likely to occur in a sliding surface, and accompanying this, the frictional resistance is increased, and therefore, the wear resistance is decreased.

When the surface Vickers hardness is less than the above lower limit, in the case where the titanium sintered body slides with a counter member, the surface of the titanium sintered body is gradually shaved off by the counter member, and therefore is likely to wear out. On the other hand, when the surface Vickers hardness exceeds the above upper limit, the toughness of the titanium sintered body is decreased, and in the case where a load during sliding is extremely large or in the case where an excessive impact is applied thereto during sliding, or the like, the titanium sintered body may be cracked or broken.

The oxygen content (concentration expressed in terms of element) is set to preferably 3000 ppm or more and 5000 ppm or less, more preferably 3500 ppm or more and 4500 ppm or less.

The surface Vickers hardness is set to preferably 300 or more and 450 or less, more preferably 350 or more and 400 or less.

The oxygen content in the titanium sintered body can be measured by, for example, an atomic absorption spectrometer, an ICP optical emission spectrometer, an oxygen-nitrogen simultaneous analyzer, or the like. In particular, a method for determination of oxygen content in metallic materials specified in JIS Z 2613 (2006) is also used. For example, an oxygen-nitrogen analyzer, TC-300/EF-300 manufactured by LECO Corporation is used.

On the other hand, the surface Vickers hardness can be measured in accordance with the Vickers hardness test method specified in JIS Z 2244 (2009). Incidentally, a test force applied by an indenter is set to 9.8 N (1 kgf), and the duration of the test force is set to 15 seconds. Then, an average of the measurement results at 10 sites is determined as the surface Vickers hardness.

It is preferred that at least part of oxygen contained in the titanium sintered body is present in the form of titanium oxide as described above.

At this time, the titanium sintered body may contain titanium oxide in any form, but preferably contains particles composed mainly of titanium oxide (hereinafter abbreviated as "titanium oxide particles"). It is considered that the titanium oxide particles share the stress applied to metallic titanium serving as a matrix by being dispersed in the titanium sintered body. Therefore, by including the titanium oxide particles, the mechanical strength of the titanium sintered body as a whole is improved. Further, titanium oxide is harder than metallic titanium, and therefore, by dispersing the titanium oxide particles, the wear resistance of the titanium sintered body can be further increased.

The term "particles composed mainly of titanium oxide" refers to particles analyzed such that an element contained in the largest amount is either one of titanium and oxygen, and an element contained in the second largest amount is the other element when a component analysis of the particles of interest is performed by an X-ray fluorescence analysis or an electron microprobe analyzer.

The average particle diameter of the titanium oxide particles is not particularly limited, but is preferably 0.5 μm or more and 20 μm or less, more preferably 1 μm or more and 15 μm or less, further more preferably 2 μm or more and 10 μm or less. When the average particle diameter of the titanium oxide particles is within the above range, the wear resistance can be increased without deteriorating the mechanical properties such as toughness and tensile strength of the titanium sintered body. That is, when the average particle diameter of the titanium oxide particles is less than the above lower limit, the stress sharing effect of the titanium oxide particles may be decreased depending on the content of the titanium oxide particles. On the other hand, when the average particle diameter of the titanium oxide particles exceeds the above upper limit, the titanium oxide particle may serve as a starting point of a crack to decrease the mechanical strength depending on the content of the titanium oxide particles.

The crystal structure of the titanium oxide particle may be any of a rutile type, an anatase type, and a brookite type, and may be a mixture of a plurality of types.

The average particle diameter of the titanium oxide particles is measured as follows. First, the cross section of the titanium sintered body is observed with an electron microscope, and 100 or more titanium oxide particles in the obtained observation image are randomly selected. At this time, whether a particle is the titanium oxide particle or not can be specified by the contrast of the image and an area analysis of oxygen or the like. Subsequently, the area of each titanium oxide particle selected in the observation image is calculated, and the diameter of a circle having the same area as that of this area is obtained. The diameter of the circle obtained in this manner is regarded as the particle diameter (equivalent circle diameter) of the titanium oxide particle, and an average for 100 or more titanium oxide particles is obtained. This average is determined as the average particle diameter of the titanium oxide particles.

Next, the crystal structure of the titanium sintered body will be described.

Figure 2:
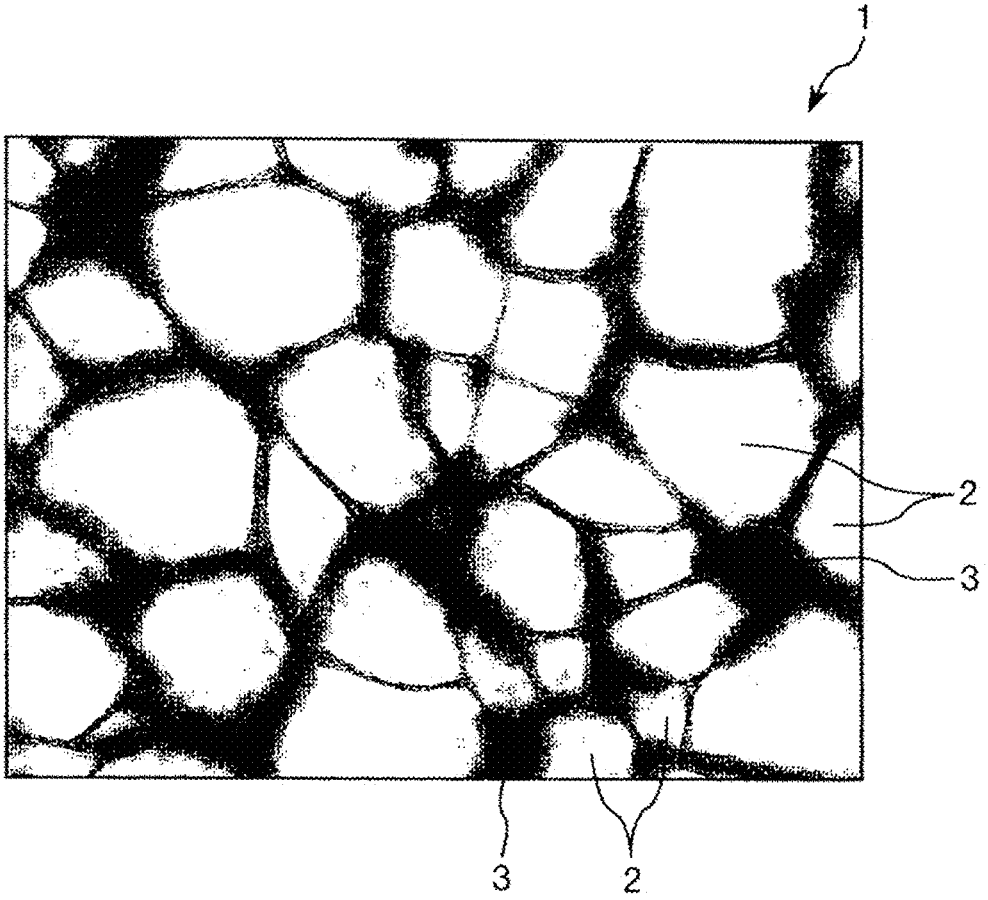
FIG. 2 is a view schematically drawing a part of the electron microscopic image shown in FIG. 1.

FIG. 1 is an electron microscopic image showing an embodiment of the titanium sintered body according to the invention, and FIG. 2 is a view schematically drawing a part of the electron microscopic image shown in FIG. 1. Incidentally, FIG. 1 is obtained by taking an image of a cut surface of the titanium sintered body, and a dark-colored band extending to the right and left in the upper end of FIG. 1 is a region outside the titanium sintered body. That is, the lower end of the dark-colored band corresponds to the surface of the titanium sintered body.

A titanium sintered body 1 shown in FIG. 2 contains an α-phase 2 and a β-phase 3 as crystal structures. Among these, the α-phase 2 refers to a region (α-phase titanium) in which the crystal structure forming the phase is mainly a hexagonal closest packed (hcp) structure. On the other hand, the β-phase 3 refers to a region (β-phase titanium) in which the crystal structure forming the phase is mainly a body-centered cubic (bcc) structure. In FIG. 1, the α-phase 2 appears as a region with a relatively light color, and the β-phase 3 appears as a region with a relatively dark color.

The α-phase 2 has a relatively low hardness and high ductility, and therefore contributes to the realization of the titanium sintered body 1 having a high strength and excellent deformation resistance particularly at a high temperature. On the other hand, the β-phase 3 has a relatively high hardness, but is likely to be plastically deformed, and therefore contributes to the realization of the titanium sintered body 1 having excellent toughness as a whole.

It is preferred that most of the cross section of the titanium sintered body 1 is occupied by such an α-phase 2 and a β-phase 3. The total occupancy ratio (area ratio) of the α-phase 2 and the β-phase 3 is not particularly limited, but is preferably 95% or more, more preferably 98% or more. In such a titanium sintered body 1, the α-phase 2 and the β-phase 3 become dominant in terms of characteristics, and therefore, the titanium sintered body 1 reflects many advantages of titanium.

The total occupancy ratio of the α-phase 2 and the β-phase 3 is obtained by, for example, observing the cross section of the titanium sintered body 1 with an electron microscope, a light microscope, or the like and distinguishing the crystal phases based on the difference in color or the contrast due to the difference in crystal structure and also measuring the areas.

Examples of crystal structures other than the α-phase 2 and the β-phase 3 include an ω-phase and a γ-phase.

The titanium sintered body 1 contains the α-phase 2 and the β-phase 3 as the crystal structures as described above, and also the occupancy ratio (area ratio) of the α-phase 2 in the cross section is preferably 70% or more and 99.8% or less, more preferably 75% or more and 99% or less, further more preferably 80% or more and 98% or less. Since the α-phase 2 is dominant in this manner, while increasing the mechanical strength of the titanium sintered body 1, the sintered body is likely to be homogeneous as a whole, and therefore, also the uniformity of wear susceptibility can be increased. Due to this, when the titanium sintered body 1 is applied to a sliding component, a phenomenon of continuous acceleration of wear caused by local occurrence of a region which is likely to wear out in a sliding surface is suppressed, and therefore, the titanium sintered body 1 having higher wear resistance is obtained. In other words, it becomes difficult to make the difference in hardness between the α-phase 2 and the β-phase 3 obvious, and therefore, a sliding surface becomes smooth, so that the sintered body is hardly caught on the surface during sliding. Therefore, the frictional resistance is decreased, and thus, this can contribute to the improvement of the wear resistance. Moreover, the α-phase 2 which is dominantly present hardly causes dislocation and therefore is hardly denatured by sliding and also has high corrosion resistance. Due to this, even in the case where the sintered body is exposed to sliding for a long period of time, the wear resistance can be maintained. As a result, a polished surface can be maintained favorably for a long period of time.

On the other hand, in the case where the occupancy ratio of the α-phase 2 is as described above, the occupancy ratio of the β-phase 3 is smaller than that. However, the β-phase 3 is present preferably at an area ratio of about 0.2% or more and 30% or less, more preferably at an area ratio of about 1% or more and 25% or less, further more preferably at an area ratio of about 2% or more and 20% or less. The β-phase 3 is likely to be plastically deformed as described above, and therefore promotes the mutual sliding of the grains of the α-phase 2. Therefore, since the β-phase 3 is present at a ratio within the above range, even in the case where a large load is applied to a sliding surface during sliding, the effect of the load can be alleviated by the mutual sliding of the grains of the α-phase 2. As a result, even if a large load is applied, it becomes difficult to decrease the wear resistance.

Therefore, when the occupancy ratio of the α-phase 2 is less than the above lower limit, the α-phase 2 is not dominant in the crystal structure although it depends on the ratio of the α-phase 2 to the β-phase 3, and thus, a sliding surface is less likely to be smooth, and the frictional resistance during sliding may be increased. On the other hand, when the occupancy ratio of the α-phase 2 exceeds the above upper limit, the occupancy ratio of the β-phase 3 becomes very small although it depends on the content of the crystal structures other than the α-phase 2 and the β-phase 3, and therefore, when a large load is applied to a sliding surface, the effect thereof may not be able to be alleviated.

The occupancy ratio of the α-phase 2 is measured as follows. First, the cross section of the titanium sintered body 1 is observed with an electron microscope, and the area of the obtained observation image is calculated. Subsequently, the total area of the α-phase 2 in the observation image is obtained. Then, the obtained total area of the α-phase 2 is divided by the area of the observation image, whereby the area ratio is obtained. This area ratio is the occupancy ratio of the α-phase 2.

Further, in the cross section of the titanium sintered body 1, the configuration that the α-phase 2 is minute is also one of the important factors. For example, the average grain size of the α-phase 2 in the cross section is preferably 3 μm or more and 30 μm or less, more preferably 5 μm or more and 25 μm or less, further more preferably 7 μm or more and 20 μm or less. The α-phase 2 having such an average grain size is minute, and therefore it becomes more difficult to cause dislocation. Due to this, the hardness of the titanium sintered body 1 can be further increased, and also a sliding surface is more likely to be smooth, and thus, the frictional resistance can be further decreased. In addition, the polished surface polished favorably can be kept in that state for a long period of time.

When the average grain size of the α-phase 2 is less than the above lower limit, the grain size of the α-phase 2 is too small, and therefore, the occupancy ratio of the α-phase 2 may not be able to be sufficiently increased. In addition, the mechanical strength of the titanium sintered body 1 may not be able to be sufficiently increased. On the other hand, when the average grain size of the α-phase 2 exceeds the above upper limit, dislocation is likely to occur in the α-phase 2, and therefore, a sliding surface is likely to be denatured, and wear resistance may be decreased in the case where the sintered body is exposed to sliding for a long period of time. In addition, the polished surface is likely to be scratched due to the decrease in wear resistance, and therefore, it may be difficult to maintain the polished surface favorably for a long period of time. Moreover, the mechanical strength derived mainly from the α-phase 2 may be decreased.

The average grain size of the α-phase 2 is measured as follows. First, the cross section of the titanium sintered body 1 is observed with an electron microscope, and 100 or more grains of the α-phase 2 in the obtained observation image are randomly selected. Subsequently, the area of each grain of the α-phase 2 selected in the observation image is calculated, and the diameter of a circle having the same area as that of this area is obtained. The diameter of the circle obtained in this manner is regarded as the grain size (equivalent circle diameter) of the grain of the α-phase 2, and an average for 100 or more grains of the α-phase 2 is obtained. This average is determined as the average grain size of the α-phase 2.

The constituent material of the titanium sintered body 1 is a material containing titanium, and for example, a titanium simple substance, a titanium-based alloy, or the like is used.

The titanium-based alloy is an alloy containing titanium as a main component, but is an alloy containing, other than titanium (Ti), for example, an element such as carbon (C), nitrogen (N), oxygen (O), aluminum (Al), vanadium (V), niobium (Nb), zirconium (Zr), tantalum (Ta), molybdenum (Mo), chromium (Cr), manganese (Mn), cobalt (Co), iron (Fe), silicon (Si), gallium (Ga), tin (Sn), barium (Ba), nickel (Ni), or sulfur (S).

Such a titanium-based alloy preferably contains an α-phase stabilizing element and a β-phase stabilizing element. The titanium sintered body 1 constituted by such a titanium-based alloy can have both α-phase 2 and β-phase 3 as the crystal structures even if the production conditions or use conditions for the sintered body change, and therefore have excellent weather resistance. Due to this, the titanium sintered body 1 has the characteristics exhibited by the α-phase 2 and the characteristics exhibited by the β-phase 3, and thus has particularly excellent mechanical properties.

Examples of the α-phase stabilizing element include aluminum, gallium, tin, carbon, nitrogen, and oxygen, and these are used alone or in combination of two or more types thereof. On the other hand, examples of the β-phase stabilizing element include molybdenum, niobium, tantalum, vanadium, and iron, and these are used alone or in combination of two or more types thereof.

As a specific composition of the titanium-based alloy, a titanium alloy specified in JIS H 4600:2012 as type 60, type 60E, type 61, or type 61F can be used. Specific examples thereof include Ti-6Al-4V, Ti-6Al-4V ELI, and Ti-3Al-2.5V. Other examples thereof include Ti-6Al-6V-2Sn, Ti-6Al-2Sn-4Zr-2Mo-0.08Si, and Ti-6Al-2Sn-4Zr-6Mo specified in Aerospace Material Specifications (AMS). Further, additional examples thereof include Ti-5Al-2.5Fe and Ti-6Al-7Nb specified in the specification made by International Organization for Standardization (ISO), and also include Ti-13Zr-13Ta, Ti-6Al-2Nb-1Ta, Ti-15Zr-4Nb-4Ta, and Ti-5Al-3Mo-4Zr.

In the notation of the above-mentioned alloy composition, the components are shown in decreasing order of concentration from left to right, and the number shown before the element indicates the concentration of the element in mass %. For example, Ti-6Al-4V shows that the alloy contains Al at 6 mass % and V at 4 mass % with the remainder consisting of Ti and impurities. The impurities are elements which are inevitably contained or elements which are added intentionally at a predetermined ratio (for example, the total amount of the impurities is 0.40 mass % or less).

Further, the ranges for main alloy compositions described above are as follows.

The Ti-6Al-4V alloy contains Al at 5.5 mass % or more and 6.75 mass % or less and V at 3.5 mass % or more and 4.5 mass % or less with the remainder consisting of Ti and impurities. As the impurities, for example, Fe at 0.4 mass % or less, O at 0.2 mass % or less, N at 0.05 mass % or less, H at 0.015 mass % or less, and C at 0.08 mass % or less are permitted to be contained, respectively. Further, other elements are permitted to be contained at 0.10 mass % or less individually and 0.40 mass % or less in total, respectively.

The Ti-6Al-4V ELI alloy contains Al at 5.5 mass % or more and 6.5 mass % or less and V at 3.5 mass % or more and 4.5 mass % or less with the remainder consisting of Ti and impurities. As the impurities, for example, Fe at 0.25 mass % or less, O at 0.13 mass % or less, N at 0.03 mass % or less, H at 0.0125 mass % or less, and C at 0.08 mass % or less are permitted to be contained, respectively. Further, other elements are permitted to be contained at 0.10 mass % or less individually and 0.40 mass % or less in total, respectively.

The Ti-3Al-2.5V alloy contains Al at 2.5 mass % or more and 3.5 mass % or less, V at 1.6 mass % or more and 3.4 mass % or less, S (according to need) at 0.05 mass % or more and 0.20 mass % or less, and at least one element (according to need) selected from La, Ce, Pr, and Nd at 0.05 mass % or more and 0.70 mass % or less in total with the remainder consisting of Ti and impurities. As the impurities, for example, Fe at 0.30 mass % or less, O at 0.25 mass % or less, N at 0.05 mass % or less, H at 0.015 mass % or less, and C at 0.10 mass % or less are permitted to be contained, respectively. Further, other elements are permitted to be contained at 0.40 mass % or less in total.

The Ti-5Al-2.5Fe alloy contains Al at 4.5 mass % or more and 5.5 mass % or less and Fe at 2 mass % or more and 3 mass % or less with the remainder consisting of Ti and impurities. As the impurities, for example, O at 0.2 mass % or less, N at 0.05 mass % or less, H at 0.013 mass % or less, and C at 0.08 mass % or less are permitted to be contained, respectively. Further, other elements are permitted to be contained at 0.40 mass % or less in total.

The Ti-6Al-7Nb alloy contains Al at 5.5 mass % or more and 6.5 mass % or less and Nb at 6.5 mass % or more and 7.5 mass % or less with the remainder consisting of Ti and impurities. As the impurities, for example, Ta at 0.50 mass % or less, Fe at 0.25 mass % or less, O at 0.20 mass % or less, N at 0.05 mass % or less, H at 0.009 mass % or less, and C at 0.08 mass % or less are permitted to be contained, respectively. Further, other elements are permitted to be contained at 0.40 mass % or less in total. The Ti-6Al-7Nb alloy has particularly low cytotoxicity as compared with other alloy types, and therefore is particularly useful when the titanium sintered body 1 is used for biocompatible purposes.

The components contained in the titanium sintered body 1 can be analyzed by, for example, a method in accordance with Titanium—ICP atomic emission spectrometry specified in JIS H 1632-1 (2014) to JIS H 1632-3 (2014).

The shape of the α-phase 2 according to this embodiment is preferably not a needle shape, but an isotropic shape or a shape equivalent thereto. When the α-phase 2 has such a shape, the decrease in the fatigue strength of the titanium sintered body 1 can be suppressed as described above. As a result, the titanium sintered body 1 capable of maintaining excellent wear resistance for a long period of time is obtained.

There is an aspect ratio as an index for evaluating the shape of the crystal structure. The average aspect ratio of the α-phase 2 is set to preferably 1 or more and 3 or less, more preferably 1 or more and 2.5 or less. When the average aspect ratio of the α-phase 2 is within the above range, the decrease in the fatigue strength and the hardness of the titanium sintered body 1 is suppressed. Due to this, the titanium sintered body 1 which is useful as a structural component is obtained. Further, by adjusting the average aspect ratio within the above range, in the case where the titanium sintered body 1 is applied to a sliding component, unevenness is less likely to occur on a sliding surface. As a result, the smoothness of a sliding surface can be further increased, and thus, the titanium sintered body 1 having a particularly small sliding resistance and excellent wear resistance is obtained. When the aspect ratio exceeds the above upper limit, the shape anisotropy of the α-phase 2 is increased, and therefore, the smoothness of a sliding surface is decreased depending on the grain size of the α-phase 2, and thus, the sliding resistance may be increased.

The average aspect ratio of the α-phase 2 is measured as follows. First, the cross section of the titanium sintered body 1 is observed with an electron microscope, and 100 or more grains of the α-phase 2 in the obtained observation image are randomly selected. Subsequently, the major axis of the grain of the α-phase 2 selected in the observation image is specified, and further, the longest axis in the direction orthogonal to this major axis is specified as the minor axis. Then, the ratio of the major axis to the minor axis is calculated as the aspect ratio. Then, the aspect ratios of 100 or more grains of the α-phase 2 is averaged, and the resulting value is determined as the average aspect ratio.

In the titanium sintered body 1, it is preferred that the α-phase 2 has a uniform grain size. Not only because the shape of the α-phase 2 is an isotropic shape as described above or a shape equivalent thereto, but also because the grain size is uniform, the titanium sintered body 1 has a high fatigue strength and also has excellent wear resistance for a long period of time.

When the measurement result of the grain size of the α-phase 2 is plotted in a plot area in which the grain size of the α-phase 2 is indicated along the horizontal axis and the number of grains of the α-phase 2 corresponding to the grain size is indicated along the vertical axis, a grain size distribution of the α-phase 2 is obtained. In this grain size distribution, the grain size when the cumulative number of grains from the small grain size side reaches 16% of the total is represented by D16, and the grain size when the cumulative number of grains from the small grain size side reaches 84% of the total is represented by D84. At this time, the standard deviation SD of the grain size distribution is obtained according to the following formula.

$$SD=(D84-D16)/2$$

The standard deviation SD obtained in this manner serves as the index of the distribution width of the grain size distribution. In the titanium sintered body 1, the standard deviation SD of the grain size distribution of the α-phase 2 is preferably 5 or less, more preferably 3 or less, further more preferably 2 or less. In the titanium sintered body 1 in which the standard deviation SD of the grain size distribution of the α-phase 2 is within the above range, the grain size distribution is sufficiently narrow, and also the grain size of the α-phase 2 is sufficiently uniform. Such a titanium sintered body 1 has a particularly high fatigue strength, and can maintain excellent wear resistance for a long period of time.

Further, an X-ray diffraction spectrum obtained by subjecting the titanium sintered body 1 to a crystal structure analysis by X-ray diffractometry includes, for example, a peak reflection intensity derived from the α-phase and a peak reflection intensity derived from the β-phase.

It is preferred that the X-ray diffraction spectrum obtained by X-ray diffractometry particularly includes a peak reflection intensity by the plane orientation (100) of the α-phase titanium and a peak reflection intensity by the plane orientation (110) of the β-phase titanium. In addition, in the X-ray diffraction spectrum, the value of the peak reflection intensity (the value of the peak top) by the plane orientation (110) of the β-phase titanium is preferably 5% or more and 60% or less, more preferably 10% or more and 50% or less, further more preferably 15% or more and 40% or less of the value of the peak reflection intensity (the value of the peak top) by the plane orientation (100) of the α-phase titanium. According to this, the characteristics of the α-phase 2 and the characteristics of the β-phase 3 described above become obvious without being hidden. That is, the α-phase 2 hardly causes dislocation and therefore is hardly denatured by sliding and also has high corrosion resistance. On the other hand, the β-phase 3 promotes the mutual sliding of the grains of the α-phase 2. Therefore, even if a large load is applied to a sliding surface, the effect of the load can be alleviated by the mutual sliding of the grains of the α-phase 2. Due to this, by making the function of each of these phases obvious, a synergistic effect is obtained without cancelling out the effects of both phases. As a result, the titanium sintered body 1 capable of maintaining excellent wear resistance for a long period of time even if a large load is applied to a sliding surface is obtained.

The peak reflection intensity by the plane orientation (100) of the α-phase titanium is located at 2θ of about 35.3°. On the other hand, the peak reflection intensity by the plane orientation (110) of the β-phase titanium is located at 2θ of about 39.5°.

As the X-ray source of the X-ray diffractometer, Cu-Kα radiation is used, and the tube voltage is set to 30 kV, and the tube current is set to 20 mA.

Further, the titanium sintered body 1 has a relative density of preferably 99% or more, more preferably 99.5% or more. By setting the relative density of the titanium sintered body 1 within the above range, it becomes difficult to expose pores on a sliding surface. Due to this, it becomes difficult to cause wear starting from the pores, so that the frictional resistance is decreased, and thus, the titanium sintered body 1 showing particularly favorable wear resistance is obtained.

The relative density of the titanium sintered body 1 is a dry density measured in accordance with the test method of density of sintered metal materials specified in JIS Z 2501: 2000.

The titanium sintered body 1 as described above can be applied to various uses and is particularly useful as the below-mentioned ornament or sliding component, although the use thereof is not particularly limited.

Method for Producing Titanium Sintered Body

Next, a method for producing the titanium sintered body 1 will be described.

The method for producing the titanium sintered body 1 includes [1] a step of obtaining a mixture by mixing a titanium-based powder and an organic binder, [2] a step of obtaining a molded body by molding the mixture by a powder molding method, [3] a step of obtaining a degreased body by degreasing the molded body, [4] a step of obtaining a sintered body by firing the degreased body, and [5] a step of performing a hot isostatic pressing treatment (HIP treatment) for the sintered body. Hereinafter, the respective steps will be sequentially described.

[1] Mixing Step

First, a titanium-based powder to serve as a raw material of the titanium sintered body 1 is kneaded along with an organic binder, whereby a kneaded material (mixture) is obtained.

The average particle diameter of the titanium-based powder is not particularly limited, but is preferably 1 μm or more and 50 μm or less, more preferably 5 μm or more and 40 μm or less.

The titanium-based powder is a titanium simple substance powder or a titanium alloy powder. The titanium alloy powder may be a powder (a pre-alloy powder) composed only of particles having a single alloy composition or may be a mixed powder (a pre-mix powder) obtained by mixing a plurality of types of particles having mutually different compositions. In the case of a pre-mix powder, an individual particle may be a particle containing only one type of element or a particle containing a plurality of elements as long as the pre-mix powder satisfies a compositional ratio as described above as a whole.

The content of the organic binder in the kneaded material is appropriately set according to the molding conditions, the shape to be molded, or the like, but is preferably about 2 mass % or more and 20 mass % or less, more preferably about 5 mass % or more and 10 mass % or less of the total amount of the kneaded material. By setting the content of the organic binder within the above range, the kneaded material has favorable fluidity. According to this, the filling property of the kneaded material when performing molding is improved, and a sintered body having a shape closer to a final desired shape (near-net shape) is obtained.

Examples of the organic binder include polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyamide, polyethylene terephthalate, and polybutylene terephthalate, various resins such as polyether, polyvinyl alcohol, polyvinylpyrrolidone, and copolymers thereof, and various organic binders such as various waxes, paraffins, higher fatty acids (such as stearic acid), higher alcohols, higher fatty acid esters, and higher fatty acid amides. These can be used alone or by mixing two or more types thereof.

In the kneaded material, a plasticizer may be added as needed. Examples of the plasticizer include phthalate esters (such as DOP, DEP, and DBP), adipate esters, trimellitate esters, and sebacate esters. These can be used alone or by mixing two or more types thereof.

Further, in the kneaded material, other than the titanium-based powder, the organic binder, and the plasticizer, for example, any of a variety of additives such as a lubricant, an antioxidant, a degreasing accelerator, and a surfactant can be added as needed.

The kneading conditions vary depending on the respective conditions such as the alloy composition and the particle diameter of the titanium-based powder to be used, the composition of the organic binder, and the blending amount thereof. However, for example, the kneading temperature can be set to about 50° C. or higher and 200° C. or lower, and the kneading time can be set to about 15 minutes or more and 210 minutes or less.

Further, the kneaded material is formed into a pellet (small particle) as needed. The particle diameter of the pellet is set to, for example, about 1 mm or more and 15 mm or less.

Incidentally, depending on the molding method described below, in place of the kneaded material, a granulated powder (mixture) may be produced.

[2] Molding Step

Subsequently, the obtained kneaded material (mixture) is molded, whereby a molded body is produced.

The molding method is not particularly limited, and for example, any of a variety of powder molding methods such as a powder compaction molding (compression molding) method, a metal injection molding (MIM) method, and an extrusion molding method can be used. Among these, from the viewpoint that a sintered body having a near-net shape can be produced, a metal injection molding method is preferably used.

The molding conditions in the case of a powder compaction molding method are preferably such that the molding pressure is about 200 MPa or more and 1000 MPa or less (2 t/cm$^2$ or more and 10 t/cm$^2$ or less), which vary depending on the respective conditions such as the composition and the particle diameter of the titanium-based powder to be used, the composition of the organic binder, and the blending amount thereof.

The molding conditions in the case of the titanium-based powder are preferably such that the material temperature is about 80° C. or higher and 210° C. or lower, and the injection pressure is about 50 MPa or more and 500 MPa or less (0.5 t/cm$^2$ or more and 5 t/cm$^2$ or less), which also vary depending on the respective conditions.

The molding conditions in the case of an extrusion molding method are preferably such that the material temperature is about 80° C. or higher and 210° C. or lower, and the extrusion pressure is about 50 MPa or more and 500 MPa or less (0.5 t/cm$^2$ or more and 5 t/cm$^2$ or less), which also vary depending on the respective conditions.

The thus obtained molded body is in a state where the organic binder is uniformly distributed in gaps between the particles of the titanium-based powder.

The shape and size of the molded body to be produced are determined in anticipation of shrinkage of the molded body in the subsequent degreasing step and firing step.

Further, according to need, the molded body may be subjected to machining processing such as grinding, polishing, or cutting. The molded body has a relatively low hardness and relatively high plasticity, and therefore, machining processing can be easily performed while preventing the molded body from losing its shape. According to such machining processing, the titanium sintered body 1 having high dimensional accuracy can be more easily obtained in the end.

[3] Degreasing Step

Subsequently, the thus obtained molded body is subjected to a degreasing treatment (binder removal treatment), whereby a degreased body is obtained.

Specifically, the degreasing treatment is performed in such a manner that the organic binder is decomposed by heating the molded body, whereby at least part of the organic binder is removed from the molded body.

Examples of the degreasing treatment include a method of heating the molded body and a method of exposing the molded body to a gas capable of decomposing the binder.

In the case of using a method of heating the molded body, the heating conditions for the molded body are preferably such that the temperature is about 100° C. or higher and 750° C. or lower and the time is about 0.1 hours or more and 20 hours or less, and more preferably such that the temperature is about 150° C. or higher and 600° C. or lower and the time is about 0.5 hours or more and 15 hours or less, which slightly vary depending on the composition and the blending amount of the organic binder. According to this, the degreasing of the molded body can be necessarily and sufficiently performed without sintering the molded body. As a result, it is possible to reliably prevent the organic binder component from remaining inside the degreased body in a large amount.

The atmosphere when the molded body is heated is not particularly limited, and an atmosphere of a reducing gas such as hydrogen, an atmosphere of an inert gas such as nitrogen or argon, an atmosphere of an oxidative gas such as air, a reduced pressure atmosphere obtained by reducing the pressure of such an atmosphere, or the like can be used.

Examples of the gas capable of decomposing the binder include ozone gas.

Incidentally, by dividing this degreasing step into a plurality of steps in which the degreasing conditions are different, and performing the plurality of steps, the organic binder in the molded body can be more rapidly decomposed and removed so that the organic binder does not remain in the molded body.

Further, according to need, the degreased body may be subjected to machining processing such as grinding, polishing, or cutting. The degreased body has a relatively low hardness and relatively high plasticity, and therefore, the machining processing can be easily performed while preventing the degreased body from losing its shape. According to such machining processing, the titanium sintered body 1 having high dimensional accuracy can be more easily obtained in the end.

(4) Firing Step

Subsequently, the obtained degreased body is fired in a firing furnace, whereby a sintered body is obtained. That is, diffusion occurs at the boundary surface between the particles of the titanium-based powder, resulting in sintering. As a result, the titanium sintered body 1 is obtained.

The firing temperature varies depending on the composition, the particle diameter, and the like of the titanium-based powder, but is set to, for example, about 900° C. or higher and 1400° C. or lower, and is preferably set to about 1050° C. or higher and 1300° C. or lower.

The firing time is set to 0.2 hours or more and 7 hours or less, but is preferably set to about 1 hour or more and 6 hours or less.

In the firing step, the firing temperature or the below-mentioned firing atmosphere may be changed during the step.

The atmosphere when performing firing is not particularly limited, however, in consideration of prevention of significant oxidation of the metal powder, an atmosphere of a reducing gas such as hydrogen, an atmosphere of an inert gas such as argon, a reduced pressure atmosphere obtained by reducing the pressure of such an atmosphere, or the like is preferably used.

In the case where the titanium sintered body 1 is produced from the titanium-based powder, depending on the firing conditions or the like, both α-phase 2 and β-phase 3 are sometimes formed. In particular, in the case where the above-mentioned β-phase stabilizing element is contained in the titanium-based powder, the β-phase 3 is more reliably formed.

On the other hand, by optimizing the respective production conditions, the oxygen content in the titanium sintered body 1 can be adjusted. For example, the titanium sintered body 1 can be produced using the titanium-based powder, however, by appropriately changing the oxygen content in the titanium-based powder, the oxygen content in the titanium sintered body 1 can be adjusted. Specifically, when the titanium-based powder is produced from a metal melt (a molten material of a raw material), by bringing a powder in an uncooled state (in a high-temperature state) into contact with water or an oxygen-containing atmosphere, or ensuring a long contacting time, or the like, the oxygen content in the titanium-based powder can be increased. Oxygen contained in the titanium-based powder is present in a state of, for example, titanium oxide or the like, and is likely to migrate into the titanium sintered body 1 as it is, and therefore, the oxygen content in the titanium sintered body 1 can be increased.

The oxygen content in the titanium-based powder to be used is not particularly limited, but is preferably 300 ppm by mass or more and 5000 ppm by mass or less, more preferably 500 ppm by mass or more and 3000 ppm by mass or less. By using the alloy powder having an oxygen content within such a range, the titanium sintered body 1 having a relatively high oxygen content without inhibiting the sinterability of the titanium-based powder can be obtained.

Other than these, the supply of oxygen from a decomposition product of the organic binder, the supply of oxygen from a furnace body of a heating furnace or an atmosphere therein, or the like is also one of the factors in increasing the oxygen content.

Further, by optimizing the respective production conditions, the ratio occupied by the α-phase 2 in the titanium sintered body 1, that is, the area ratio occupied by the α-phase 2 in the cross section of the titanium sintered body 1 can be adjusted. For example, when the firing temperature is increased, the ratio of the β-phase 3 is increased, and therefore, the firing temperature may be adjusted so that the ratio of the β-phase 3 falls within the desired range, and also the firing time may be set in consideration of the increase in the size of the crystal structure caused by a too long firing time.

Therefore, for example, in the case where the titanium sintered body 1 is produced using the titanium-based powder which contains almost no β-phase 3, depending on the composition of the titanium-based powder, the ratio of the β-phase 3 tends to increase as the firing temperature is increased, and therefore, the firing temperature may be adjusted so that the area ratio of the α-phase 2 falls within the above range, and also the firing time may be set so that insufficient sintering or excessive sintering is not caused by adjusting the firing temperature.

Further, as the production conditions are optimized in this manner, also the grain size of the α-phase 2 can be adjusted. The grain size of the α-phase 2 tends to increase as the firing temperature is increased or the firing time is increased, and therefore, the firing temperature or the firing time may be set so that the grain size of the α-phase 2 falls within the above range.

The surface hardness of the titanium sintered body 1 has a high tendency to depend on the grain size of the α-phase 2. When the grain size of the α-phase 2 is decreased, the hardness tends to increase, and when the grain size of the α-phase 2 is increased, the hardness tends to decrease. Therefore, in order to adjust the grain size of the α-phase 2, by setting the firing temperature or the firing time, the surface Vickers hardness of the titanium sintered body 1 can be made to fall within the above range.

In the case where the average grain size of the α-phase 2 is within the above range, as the area ratio of the α-phase 2 is increased, the shape of the α-phase 2 tends to be close to an isotropic shape. This is considered to be because the probability that the grains of the α-phase 2 are located adjacent to each other is increased as the ratio of the β-phase 3 is decreased, and anisotropic grain growth is inhibited by the mutual interference of the grains of the α-phase 2. Therefore, it is also possible to adjust the aspect ratio as well as the grain size of the α-phase 2.

[5] HIP Step

The thus obtained sintered body may be further subjected to an HIP treatment (hot isostatic pressing treatment) or the like. By doing this, the density of the sintered body is further increased, and thus, an ornament having further excellent mechanical properties can be obtained.

As the conditions for the HIP treatment, for example, the temperature is set to 850° C. or higher and 1200° C. or lower, and the time is set to about 1 hour or more and 10 hours or less.

Further, the pressure to be applied is preferably 50 MPa or more, more preferably 100 MPa or more and 500 MPa or less.

In addition, the obtained sintered body may be further subjected to an annealing treatment, a solution heat treatment, an aging treatment, a hot working treatment, a cold working treatment, or the like as needed.

The obtained titanium sintered body 1 may be subjected to, for example, a machining process such as a polishing treatment as needed. The polishing treatment is not particularly limited, however, examples thereof include electrolytic polishing, buffing, dry polishing, chemical polishing, barrel polishing, and sand blasting. By performing such a polishing treatment, metallic luster is further given to the surface of the titanium sintered body 1, and the specularity can be increased. The surface having high specularity has a small sliding resistance, and therefore has higher wear resistance.

Ornament

Next, an embodiment of an ornament according to the invention will be described.

Examples of the ornament according to this embodiment include external components for watches such as watch cases (case bodies, case backs, one-piece cases in which a case body and a case back are integrated, etc.), watchbands (including band clasps, band-bangle attachment mechanisms, etc.), bezels (for example, rotatable bezels, etc.), crowns (for example, screw-lock crowns, etc.), buttons, glass frames, dial rings, etching plates, and packings, personal ornaments such as glasses (for example, glasses frames), tie clips, cuff buttons, rings, necklaces, bracelets, anklets, brooches, pendants, earrings, and pierced earrings, tableware such as spoons, forks, chopsticks, knives, butter knives, and corkscrews, lighters or lighter cases, sports goods such as golf clubs, nameplates, panels, prize cups, and external components for apparatuses such as housings (for example, housings for cellular phones, smartphones, tablet terminals, wearable terminals, mobile computers, music players, cameras, shavers, etc.). For any of these ornaments, excellent aesthetic appearance is sometimes regarded very highly. By including the titanium sintered body 1 in at least part of these ornaments, excellent wear resistance can be imparted to the surfaces of the ornaments. According to this, scratching or wear is suppressed, and an ornament capable of maintaining excellent aesthetic appearance for a long period of time is obtained. Further, specularity can be imparted to the surface of the ornament. Also from this viewpoint, the ornament according to this embodiment has excellent aesthetic appearance.

Figure 3:
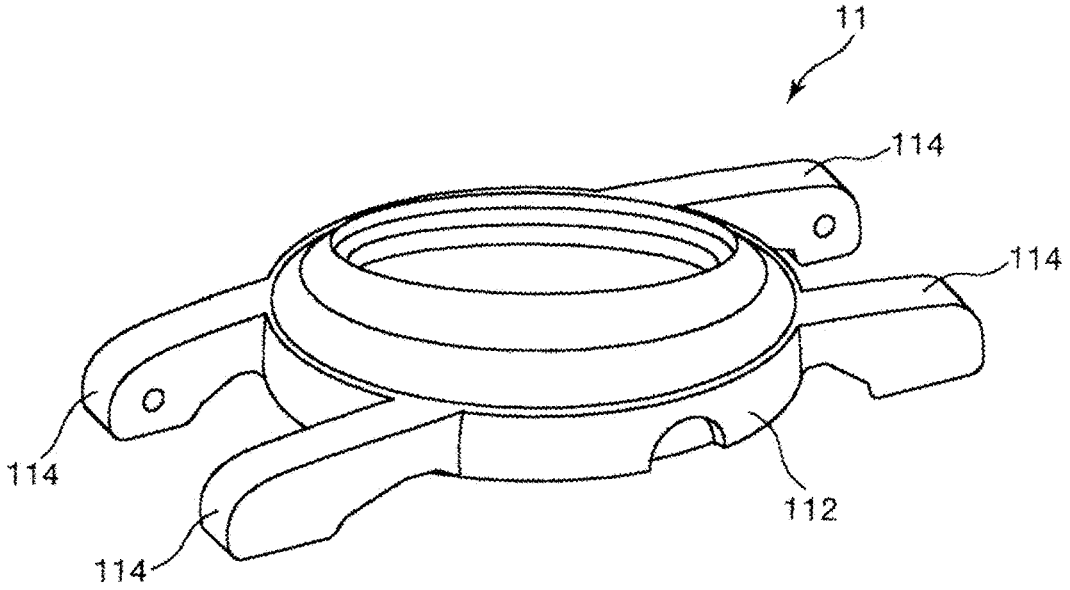
FIG. 3 is a perspective view showing a watch case to which an embodiment of an ornament according to the invention is applied.
Figure 4:
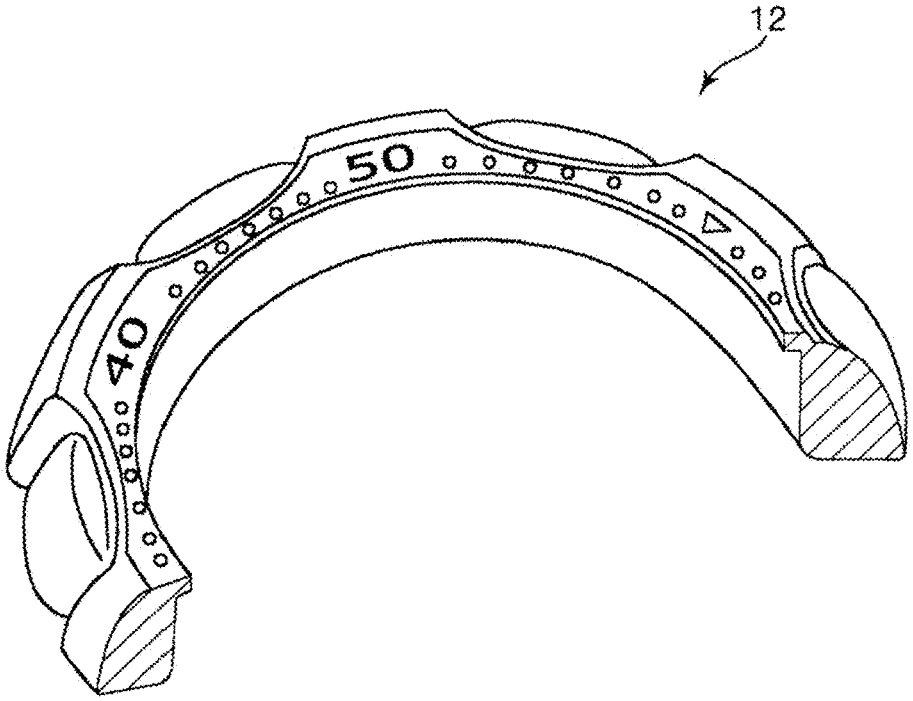
FIG. 4 is a partial cross-sectional perspective view showing a bezel to which an embodiment of an ornament according to the invention is applied.

FIG. 3 is a perspective view showing a watch case to which the embodiment of the ornament according to the invention is applied. FIG. 4 is a partial cross-sectional perspective view showing a bezel to which the embodiment of the ornament according to the invention is applied.

A watch case 11 shown in FIG. 3 includes a case main body 112 and a band attachment section 114 for attaching a watch band provided protruding from the case main body 112. Such a watch case 11 can form a container along with a glass plate (not shown) and a case back (not shown). In this container, a movement (not shown), a dial plate (not shown), etc. are housed. Therefore, this container protects the movement and the like from the external environment and also has a great influence on the aesthetic appearance of the watch.

A bezel 12 shown in FIG. 4 has an annular shape, and is attached to a watch case, and is rotatable with respect to the watch case as needed. When the bezel 12 is attached to a watch case, the bezel 12 is located outside the watch case, and therefore has an influence on the aesthetic appearance of the watch.

Such a watch case 11 and a bezel 12 are used in a state where they are worn on the human body, and therefore are always likely to be scratched. Due to this, by using the titanium sintered body 1 as a constituent material of such an ornament, an ornament having high specularity on the surface and also having excellent aesthetic appearance is obtained. Further, this specularity can be maintained for a long period of time.

In addition, the watch case 11 and the bezel 12 are sometimes subjected to a polishing treatment for removing scratches on the surface (overhaul). The watch case 11 and the bezel 12 containing the titanium sintered body 1 according to this embodiment are less likely to badly wear out or cause unevenness even if they are subjected to such a polishing treatment, and therefore, the polishing treatment is easily performed. That is, such a watch case 11 and a bezel 12 have high surface specularity and can maintain a state where the aesthetic appearance is excellent even if they are subjected to a polishing treatment (a possibility that the specularity is deteriorated by polishing is low).

Sliding Component

Next, a sliding component will be described as an application example of the titanium sintered body 1 according to the invention.

Examples of the sliding component include components for industrial machinery such as components for electric motors, components for electrical generators, components for pumps, and components for compressors, components for transport machinery such as components for automobiles (for example, engine structural components and the like such as pistons, tappets, and connecting rods), components for bicycles, components for railroad cars, components for ships, components for airplanes, and components for space transport machinery (such as rockets), components for electronic devices such as components for personal computers, components for cellular phone terminals, and components for civilian robots, components for electrical devices such as components for refrigerators, components for washing machines, and components for cooling and heating machines, components for devices such as components for machine tools, components for semiconductor production devices, and components for industrial robots, and components for plants to be used in plants such as atomic power plants, thermal power plants, hydroelectric power plants, oil refinery plants, and chemical complexes.

Any of these components slides with a counter member in a state where a load is applied to a sliding surface. Therefore, by using the titanium sintered body 1 in at least part of such a sliding component, the sliding component having excellent wear resistance for a long period of time is realized.

Heat Resistant Component

First Embodiment

The heat resistant component according to the invention can be applied to, for example, a supercharger component. The supercharger component described below is a first embodiment of the heat resistant component according to the invention, and contains the above-mentioned titanium sintered body. That is, at least part of the supercharger component described below is constituted by the above-mentioned titanium sintered body. Such a supercharger component serves as a heat resistant component having a high density and excellent wear resistance and heat resistance without performing an additional treatment (or with fewer additional treatments).

Examples of such a supercharger component include a nozzle vane for a turbocharger, a turbine wheel for a turbocharger, an impeller wheel for a turbocharger, a waste gate valve, a turbine shaft, a housing, a drive ring, a drive lever, a nozzle ring, a nozzle plate, a unison ring, an arm, a link, and a rod. Any of these supercharger components may be exposed to a high temperature over a long period of time, and also slides between other components in some cases, and therefore is required to have wear resistance. As described above, the titanium sintered body according to the invention has a high density, and therefore has excellent heat resistance and mechanical properties. Due to this, a supercharger component having excellent long-term durability is obtained.

Hereinafter, as an example of the supercharger component, a nozzle vane for a turbocharger (hereinafter also referred to in short as "nozzle vane") will be described. The nozzle vane is used for a variable displacement turbocharger and is a valve body for controlling a supercharging pressure by adjusting the nozzle opening degree.

Figure 6:
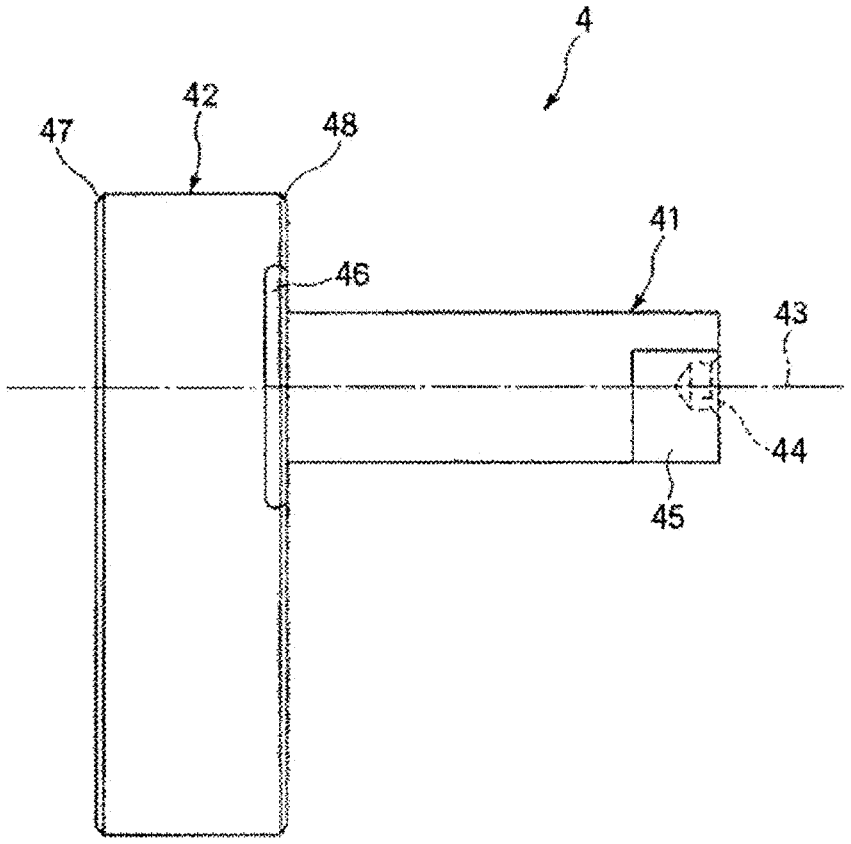
FIG. 6 is a side view showing a nozzle vane for a turbocharger (a view when a blade section is viewed in a plan view) to which a first embodiment of a heat resistant component according to the invention is applied.
Figure 7:
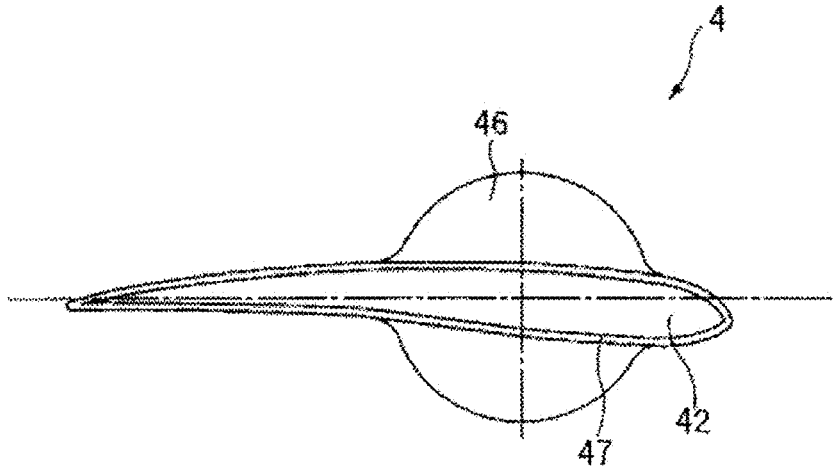
FIG. 7 is a plan view of the nozzle vane shown in FIG. 6.
Figure 8:
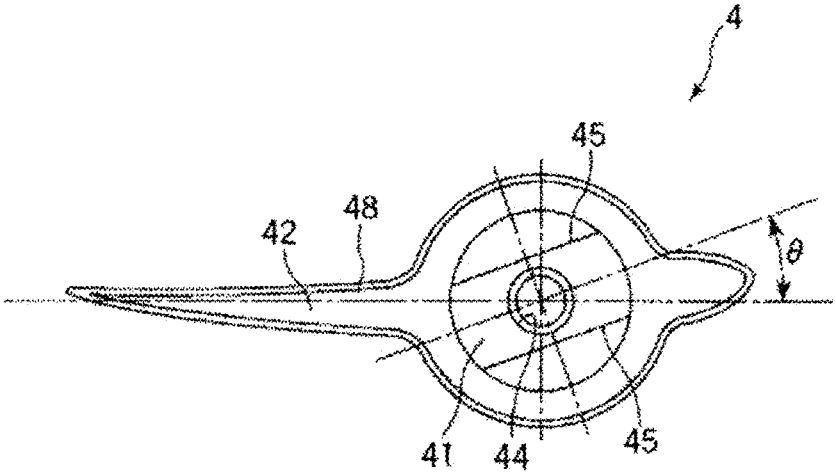
FIG. 8 is a rear view of the nozzle vane shown in FIG. 6.

FIG. 6 is a side view showing a nozzle vane for a turbocharger (a view when a blade section is viewed in a plan view) to which the first embodiment of the heat resistant component according to the invention is applied. FIG. 7 is a plan view of the nozzle vane shown in FIG. 6, and FIG. 8 is a rear view of the nozzle vane shown in FIG. 6.

A nozzle vane 4 shown in FIG. 6 includes a shaft section 41 and a blade section 42.

The shaft section 41 is configured such that the transverse cross-sectional shape of the main section is a circle with an axial line 43 as the central axis. This shaft section 41 is configured such that a portion on the blade section 42 side (the left side in FIG. 6) is rotatably supported by a nozzle mount (not shown), and a portion on the opposite side to the blade section 42 (the right side in FIG. 6) is fixed to a nozzle plate (not shown). According to this, the blade section 42 is rotated around the axial line 43 and its angle can be changed, and the nozzle opening degree can be adjusted.

Further, a center hole 44 is formed on one end face (an end face on the right side in FIG. 6) of the shaft section 41. This center hole 44 is formed such that the transverse cross-sectional shape thereof is a circle and the center thereof coincides with the axial line 43.

The outer peripheral surface on one end side (the right side in FIG. 6) of the shaft section 41 is provided with a pair of flat sections 45 (a two-side cut section) facing each other through the axial line 43 (see FIG. 8).

Each of such flat sections 45 is used in a state of being in contact with a contact face formed on a lever plate (not shown). A rotation angle around the axial line 43 of the shaft section 41 is regulated, so that a rotation angle around the axial line 43 of the nozzle vane 4 can be highly accurately adjusted. Further, each flat section 45 is formed so as to be inclined at an angle θ with respect to the protruding direction (blade surface) of the blade section 42 (see FIG. 8).

On the other hand, on the other end side (an end portion on the left side in FIG. 6) of the shaft section 41, the blade section 42 is provided. That is, the blade section 42 is provided so as to protrude from the one end portion of the shaft section 41.

Further, on the other end side of the shaft section 41, a flange section 46 protruding outside the shaft section 41 is formed.

Such a blade section 42 has a strip shape extending in a direction perpendicular to the axial line 43 of the shaft section 41 as shown in FIG. 6 in a plan view. Further, the length of the protrusion of the blade section 42 from the shaft section 41 on one end side (the lower side in FIG. 6) is longer than the other end side (the upper side in FIG. 6).

Further, chamfers 47 and 48 are formed in edge portions in both end portions in the width direction (the lateral direction in FIG. 6) in a plan view of the blade section 42.

Further, as shown in FIGS. 7 and 8, the blade section 42 is slightly curved in the thickness direction. In addition, the thickness of the blade section 42 gradually decreases toward each end in the extending direction (protruding direction).

The nozzle vane 4 as described above includes the titanium sintered body according to the invention. According to this, the nozzle vane 4 has excellent heat resistance and mechanical properties, and also has excellent wear resistance. Further, even if the nozzle vane 4 has a complicated shape, it has high dimensional accuracy. As a result, a supercharger capable of exhibiting excellent performance over a long period of time can be realized.

Incidentally, the shape and the like of the nozzle vane 4 described above are examples, and are not limited thereto.

Second Embodiment

Figure 9:
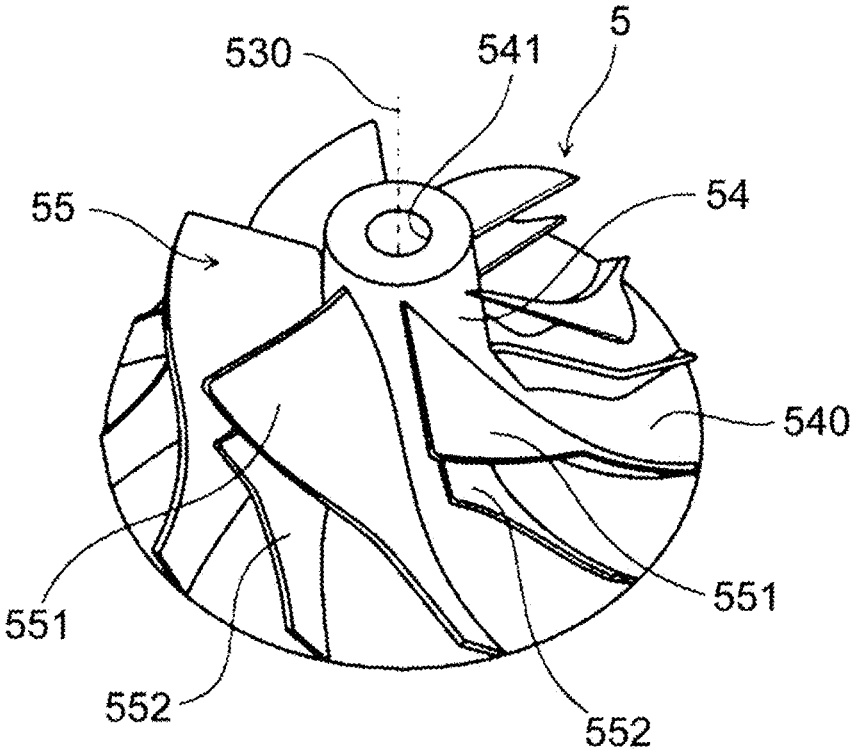
FIG. 9 is a front view showing an impeller wheel for a turbocharger to which a second embodiment of a heat resistant component according to the invention is applied.

FIG. 9 is a front view showing an impeller wheel for a turbocharger to which a second embodiment of the heat resistant component according to the invention is applied. An impeller wheel for a turbocharger (hereinafter also referred to in short as "impeller wheel") is a component which generates a rotational force by receiving a pressure of an exhaust gas or the like in a turbocharger.

An impeller wheel 5 shown in FIG. 9 includes a hub section 54 and a plurality of blade sections 55 provided on the outer peripheral surface of the hub section 54.

Further, the hub section 54 includes a through-hole 541 for allowing a shaft to pass therethrough.

The plurality of blade sections 55 each include a long blade section 551 and a short blade section 552 having a mutually different length in the direction of a rotation axis 530 of the impeller wheel 5. The long blade section 551 and the short blade section 552 are alternately disposed at equal intervals in the circumferential direction of the outer periphery of the hub section 54.

Further, the long blade section 551 is disposed from a lower end to an upper end of the impeller wheel 5 shown in FIG. 9. Then, the long blade section 551 has a shape curved in the circumferential direction of the outer periphery of the hub section 54.

On the other hand, the short blade section 552 is disposed from a lower end to an upper end of the impeller wheel 5 shown in FIG. 9, but is provided shorter than the long blade section 551. Then, also the short blade section 552 has a shape curved in the circumferential direction of the outer periphery of the hub section 54.

Such an impeller wheel 5 includes the titanium sintered body according to the invention. According to this, the impeller wheel 5 has excellent heat resistance and mechanical properties, and also has excellent wear resistance. Further, even if the impeller wheel 5 has a three-dimensional complicated shape, it has high dimensional accuracy. As a result, a supercharger capable of exhibiting excellent performance over a long period of time can be realized.

Incidentally, the shape and the like of the impeller wheel 5 described above are examples, and are not limited thereto.

Third Embodiment

The heat resistant component according to the invention can be applied to, for example, a compressor blade, which is a jet engine component or a power generation turbine component. Such a compressor blade is a third embodiment of the heat resistant component according to the invention, and at least part of the component is constituted by the titanium sintered body according to the invention.

Figure 10:
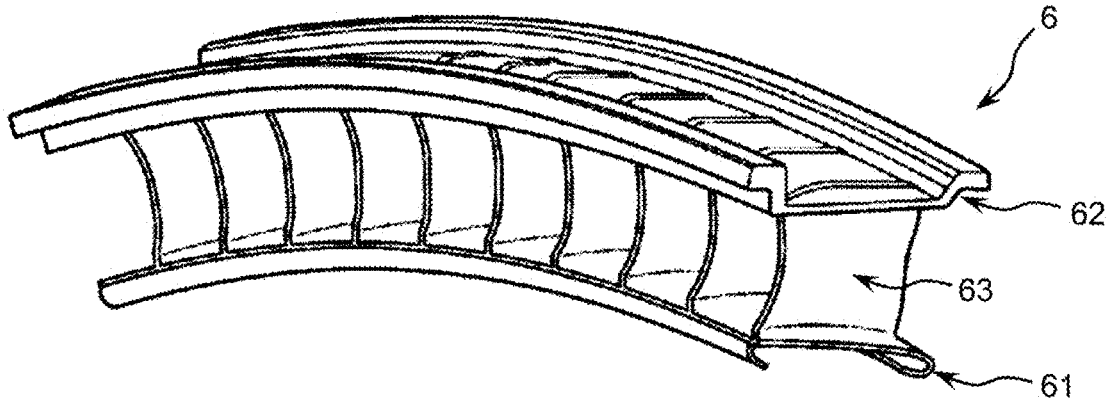
FIG. 10 is a perspective view showing a compressor blade to which a third embodiment of a heat resistant component according to the invention is applied.

FIG. 10 is a perspective view showing a compressor blade to which the third embodiment of the heat resistant component according to the invention is applied. A compressor blade 6 shown in FIG. 10 includes an inner rim 61 and an outer rim 62 which are mutually concentrically provided, and blade sections 63 which are provided therebetween and arranged in the circumferential direction of the inner rim 61. The inner rim 61 and the outer rim 62 each have a shape obtained by cutting a part of an annular ring. That is, the compressor blade 6 shown in FIG. 10 corresponds to one segment of a plurality of segments obtained by dividing the entire compressor blade in an annular shape. Further, the blade section 63 has a plate shape including a curved surface. The blade tips (end faces) of each blade section 63 are bonded to the outer peripheral surface of the inner rim 61 and the inner peripheral surface of the outer rim 62.

Such a compressor blade 6 is one of the components constituting a jet engine or a power generation gas turbine, and by receiving a gas by the blade sections 63, a turbine shaft (not shown) provided on the inner side of the inner rim 61 is rotated. According to this, a compressor can compress the gas in the jet engine or the power generation gas turbine.

The inner rim 61, the outer rim 62, and the blade section 63 may be mutually different members, however, in the compressor blade 6 shown in FIG. 10, the inner rim 61, the outer rim 62, and the blade section 63 are integrally formed. Due to this, the relative positional accuracy of the respective members is high, and the component has excellent performance as the compressor blade. Then, by constituting the entire compressor blade 6 by the titanium sintered body according to the invention, the compressor blade 6 having excellent dimensional accuracy is obtained.

Further, in general, the compressor blade is required to have a three-dimensional shape such that the shape of the blade section is thinner and also includes a curved surface by the necessity to improve the aerodynamic performance.

In order to cope with such a problem, the entire compressor blade 6 is constituted by a sintered body produced by a powder metallurgy method, and therefore, even if the blade sections 63 each having a thin and complicated three-dimensional shape are included, the compressor blade 6 having high dimensional accuracy can be realized.

Further, the titanium sintered body according to the invention has a high density and excellent heat resistance, and therefore, also contributes to the improvement of the mechanical properties of the compressor blade 6. That is, the compressor blade is generally a component forming an air flow channel, and therefore is required to have sufficient fatigue strength against vibration, wear resistance, and the like even under a high temperature.

In order to cope with such a problem, the compressor blade 6 is constituted by the titanium sintered body according to the invention, and therefore has a high density and excellent heat resistance, and also has sufficient wear resistance. Therefore, the compressor blade 6 having excellent long-term durability is obtained.

Moreover, the production is performed using any of a variety of molding methods, and therefore, in the production of the compressor blade 6, almost no post-processing after sintering is needed, or the processing amount is reduced. In addition, as described above, the density is increased, and therefore, an additional treatment such as an HIP treatment is also not needed. Due to this, the production cost is reduced, and also the occurrence of a defect caused by a post-processing mark can be minimized.

Incidentally, the shape and the like of the compressor blade described above are examples, and are not limited thereto. For example, the compressor blade 6 shown in FIG. 10 is a so-called stator blade, however, the compressor blade may be a rotor blade.

Further, the titanium sintered body according to the invention can also be applied to other components constituting a jet engine or a power generation gas turbine, for example, components constituting regions other than the compressor such as a fan blade, a turbine blade, a fan disk, a mount, a shaft, a combustion chamber, and an exhaust port.

Hereinabove, the titanium sintered body, the ornament, and the heat resistant component according to the invention have been described with reference to preferred embodiments, however, the invention is not limited thereto.

For example, the use of the titanium sintered body is not limited to the ornament or the sliding component, the heat resistant component, etc. and may be other arbitrary structures (structural components). Examples of the structural components include components for transport machinery such as components for automobiles, components for bicycles, components for railroad cars, components for ships, components for airplanes, and components for space transport machinery (such as rockets), components for electronic devices such as components for personal computers and components for cellular phone terminals, components for electrical devices such as refrigerators, washing machines, and cooling and heating machines, components for machines such as machine tools and semiconductor production devices, components for plants such as atomic power plants, thermal power plants, hydroelectric power plants, oil refinery plants, and chemical complexes, medical devices such as surgical instruments, artificial bones, joint prostheses, artificial teeth, artificial dental roots, and orthodontic components.

The titanium sintered body has high biocompatibility, and therefore is particularly useful as an artificial bone and a dental metallic component. Among these, the dental metallic component is not particularly limited as long as it is a metallic component which is temporarily or semipermanently retained in the mouth, and examples thereof include metal frames such as an inlay, a crown, a bridge, a metal base, a denture, an implant, an abutment, a fixture, and a screw.

EXAMPLES

Next, specific examples of the invention will be described.

1. Production of Titanium Sintered Body

Example 1

(1) First, a Ti-6Al-4V alloy powder having an average particle diameter of 23 μm produced by a gas atomization method was prepared.

Subsequently, a mixture (organic binder) of polypropylene and a wax was prepared and weighed so that the mass ratio of the raw material powder to the organic binder was 9:1, whereby a composition for producing a titanium sintered body was obtained.

Subsequently, the obtained composition for producing a titanium sintered body was kneaded using a kneader, whereby a compound was obtained. Then, the compound was processed into pellets.

(2) Subsequently, molding was performed under the following molding conditions using the obtained pellets, whereby a molded body was produced.

Molding Conditions

Molding method: metal injection molding method

Material temperature: 150° C.

Injection pressure: 11 MPa (110 kgf/cm$^2$)

(3) Subsequently, the obtained molded body was subjected to a degreasing treatment under the following degreasing conditions, whereby a degreased body was obtained.

Degreasing Conditions

Degreasing temperature: 520° C.

Degreasing time: 5 hours

Degreasing atmosphere: nitrogen gas atmosphere (4) Subsequently, the obtained degreased body was fired under the following firing conditions, whereby a sintered body was produced.

Firing Conditions

Firing temperature: 1100° C.

Firing time: 5 hours

Firing atmosphere: argon gas atmosphere

Pressure in atmosphere: atmospheric pressure (100 kPa)

(5) Subsequently, the obtained sintered body was subjected to an HIP treatment under the following treatment conditions, whereby a titanium sintered body having the shape of a rod with a diameter of 5 mm and a length of 100 mm was obtained.

HIP Treatment Conditions

Treatment temperature: 900° C.

Treatment time: 3 hours

Treatment pressure: 1480 kgf/cm$^2$ (145 MPa)

(6) Subsequently, the obtained titanium sintered body was cut and the cut surface was polished by a buffing treatment.

Subsequently, the polished surface was observed with an electron microscope, and the average grain size of the α-phase, the area ratios occupied by the α-phase and the β-phase, and the average aspect ratio of the α-phase were obtained, respectively. The results are shown in Table 1.

Examples 2 to 6

Titanium sintered bodies were obtained in the same manner as in Example 1 except that the production conditions were changed so that the average grain size of the α-phase, the area ratios occupied by the α-phase and the β-phase, and the average aspect ratio of the α-phase were as shown in Table 1, respectively.

Comparative Examples 1 to 4

Titanium sintered bodies were obtained in the same manner as in Example 1 except that the production conditions were changed so that the average grain size of the α-phase, the area ratios occupied by the α-phase and the β-phase, and the average aspect ratio of the α-phase were as shown in Table 1, respectively.

Reference Example 1

First, a Ti-6Al-4V alloy ingot material was prepared.

Subsequently, the prepared ingot material was cut and the cut surface was polished by a buffing treatment.

Subsequently, the polished surface was observed with an electron microscope, and the average grain size of the α-phase, the area ratios occupied by the α-phase and the β-phase, and the average aspect ratio of the α-phase were obtained, respectively. The results are shown in Table 1.

Example 7

A titanium sintered body was obtained in the same manner as in Example 1 except that a Ti-3Al-2.5V alloy powder having an average particle diameter of 23 μm was used in place of the Ti-6Al-4V alloy powder.

Then, the obtained titanium sintered body was cut and the cut surface was polished by a buffing treatment.

Subsequently, the polished surface was observed with an electron microscope, and the average grain size of the α-phase, the area ratios occupied by the α-phase and the β-phase, and the average aspect ratio of the α-phase were obtained, respectively. The results are shown in Table 2.

Examples 8 to 12

Titanium sintered bodies were obtained in the same manner as in Example 7 except that the production conditions were changed so that the average grain size of the α-phase, the area ratios occupied by the α-phase and the β-phase, and the average aspect ratio of the α-phase were as shown in Table 2, respectively.

Comparative Examples 5 to 8

Titanium sintered bodies were obtained in the same manner as in Example 7 except that the production conditions were changed so that the average grain size of the α-phase, the area ratios occupied by the α-phase and the β-phase, and the average aspect ratio of the α-phase were as shown in Table 2, respectively.

Reference Example 2

First, a Ti-3Al-2.5V alloy ingot material was prepared.

Subsequently, the prepared ingot material was cut and the cut surface was polished by a buffing treatment.

Subsequently, the polished surface was observed with an electron microscope, and the average grain size of the α-phase, the area ratios occupied by the α-phase and the β-phase, and the average aspect ratio of the α-phase were obtained, respectively. The results are shown in Table 2.

Example 13

A titanium sintered body was obtained in the same manner as in Example 1 except that a Ti-6Al-7Nb alloy powder having an average particle diameter of 25 μm was used in place of the Ti-6Al-4V alloy powder.

Then, the obtained titanium sintered body was cut and the cut surface was polished by a buffing treatment.

Subsequently, the polished surface was observed with an electron microscope, and the average grain size of the α-phase, the area ratios occupied by the α-phase and the β-phase, and the average aspect ratio of the α-phase were obtained, respectively. The results are shown in Table 3.

Examples 14 to 18

Titanium sintered bodies were obtained in the same manner as in Example 13 except that the production conditions were changed so that the average grain size of the α-phase, the area ratios occupied by the α-phase and the β-phase, and the average aspect ratio of the α-phase were as shown in Table 3, respectively.

Comparative Examples 9 to 12

Titanium sintered bodies were obtained in the same manner as in Example 13 except that the production conditions were changed so that the average grain size of the α-phase, the area ratios occupied by the α-phase and the β-phase, and the average aspect ratio of the α-phase were as shown in Table 3, respectively.

Reference Example 3

First, a Ti-6Al-7Nb alloy ingot material was prepared.

Subsequently, the prepared ingot material was cut and the cut surface was polished by a buffing treatment.

Subsequently, the polished surface was observed with an electron microscope, and the average grain size of the α-phase, the area ratios occupied by the α-phase and the β-phase, and the average aspect ratio of the α-phase were obtained, respectively. The results are shown in Table 3.

2. Evaluation of Titanium Sintered Body 2.1. Oxygen Content

First, with respect to each of the titanium sintered bodies of the respective Examples and Comparative Examples and each of the titanium ingot materials of the respective Reference Examples, the oxygen content therein was measured by an oxygen-nitrogen simultaneous analyzer (TC-136, manufactured by LECO Corporation. The measurement results are shown in Tables 1 to 3.

2.2. Vickers Hardness

Subsequently, with respect to the surface of each of the titanium sintered bodies of the respective Examples and Comparative Examples and each of the titanium ingot materials of the respective Reference Examples, the Vickers hardness was measured in accordance with the method specified in JIS Z 2244:2009. The measurement results are shown in Tables 1 to 3.

2.3. Average Particle Diameter of Titanium Oxide Particles

Subsequently, with respect to each of the titanium sintered bodies of the respective Examples and Comparative Examples and each of the titanium ingot materials of the respective Reference Examples, the polished surface was visually observed with an electron microscope. Then, the titanium oxide particles in the observation image were specified and the average particle diameter thereof was calculated. The calculation results are shown in Tables 1 to 3.

2.4. Crystal Structure Analysis by X-Ray Diffractometry

Subsequently, with respect to the titanium sintered body of Example 1, a crystal structure analysis was performed by X-ray diffractometry under the following measurement conditions.

Measurement Conditions for Crystal Structure Analysis by X-ray Diffractometry

X-ray source: Cu-Kα radiation

Tube voltage: 30 kV

Tube current: 20 mA

Figure 5:
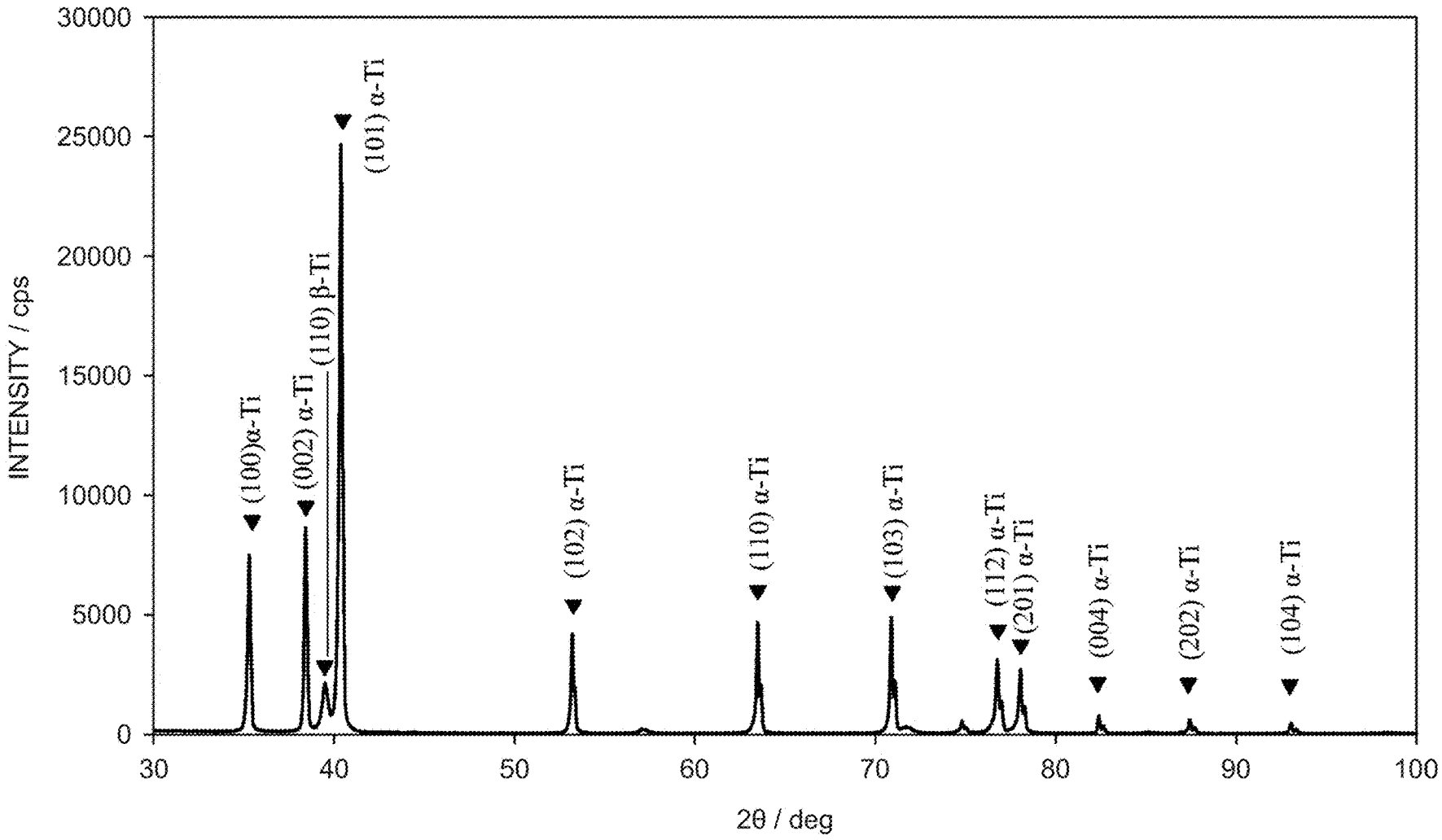
FIG. 5 is an X-ray diffraction spectrum obtained for a titanium sintered body of Example 1.

The obtained X-ray diffraction spectrum is shown in FIG. 5.

As apparent from FIG. 5, it was found that the X-ray diffraction spectrum obtained for the titanium sintered body of Example 1 includes a peak reflection intensity by the α-phase (α-Ti) and a peak reflection intensity by the β-phase (β-Ti). Then, the value of the peak reflection intensity by the α-Ti in the plane orientation (100) located at 2θ of about 35.3° was used as the standard, and the ratio (peak ratio) of the value of the peak reflection intensity by the β-Ti in the plane orientation (110) located at 2θ of about 39.5° to the standard was calculated. In addition, the same calculation was also performed for each of the titanium sintered bodies of Examples 2 to 18 and Comparative Examples 1 to 3, 5 to 7, and 9 to 11, and each of the titanium ingot materials of Reference Examples 1 to 3. The calculation results of the peak ratio are shown in Tables 1 to 3. Incidentally, in the titanium sintered bodies of Comparative Examples 4, 8, and 12, peaks other than the α-phase and the β-phase were also noticeable, and therefore, it was difficult to calculate the peak ratio.

2.5. Specularity

Subsequently, with respect to each of the titanium sintered bodies of the respective Examples and Comparative Examples and each of the titanium ingot materials of the respective Reference Examples, the polished surface was visually observed. Then, the specularity of the polished surface was evaluated according to the following evaluation criteria. The evaluation results are shown in Tables 1 to 3.

Evaluation Criteria for Specularity of Polished Surface

A: The specularity of the polished surface is very high (the aesthetic appearance is particularly good).

B: The specularity of the polished surface is slightly high (the aesthetic appearance is slightly good).

C: The specularity of the polished surface is slightly low (the aesthetic appearance is slightly poor).

D: The specularity of the polished surface is very low (the aesthetic appearance is poor).

2.6. Relative Density

Subsequently, with respect to each of the titanium sintered bodies of the respective Examples and Comparative Examples and each of the titanium ingot materials of the respective Reference Examples, the relative density was calculated in accordance with the method specified in JIS Z 2501:2000. The calculation results are shown in Tables 1 to 3.

2.7. Wear Resistance

Subsequently, with respect to each of the titanium sintered bodies of the respective Examples and Comparative Examples and each of the titanium ingot materials of the respective Reference Examples, the wear resistance of the surface thereof was evaluated. Specifically, first, the surface of each of the titanium sintered bodies and the titanium ingot materials was polished by a buffing treatment. Subsequently, for the polished surface, a wear resistance test was performed in accordance with Testing method for wear resistance of fine ceramics by ball-on-disc method specified in JIS R 1613 (2010), and a wear amount of a disk-shaped test piece was measured. The measurement conditions were as follows.

Measurement Conditions for Specific Wear Amount

Material of spherical test piece: high carbon chromium bearing steel (SUJ2)

Size of spherical test piece: diameter: 6 mm

Material of disk-shaped test piece: each of titanium sintered bodies of respective Examples and Comparative Examples and each of titanium ingot materials of respective Reference Examples Size of disk-shaped test piece: diameter: 35 mm, thickness: 5 mm Magnitude of load: 10 N Sliding rate: 0.1 m/s Sliding circle diameter: 30 mm Sliding distance: 50 m Then, the wear amount obtained for the titanium ingot material of Reference Example 1 was taken as 1, and the relative value of the wear amount obtained for each of the titanium sintered bodies of the respective Examples and Comparative Examples shown in Table 1 was calculated.

Similarly, the wear amount obtained for the titanium ingot material of Reference Example 2 was taken as 1, and the relative value of the wear amount obtained for each of the titanium sintered bodies of the respective Examples and Comparative Examples shown in Table 2 was calculated.

Further similarly, the wear amount obtained for the titanium ingot material of Reference Example 3 was taken as 1, and the relative value of the wear amount obtained for each of the titanium sintered bodies of the respective Examples and Comparative Examples shown in Table 3 was calculated.

Then, the calculated relative value was evaluated according to the following evaluation criteria. The evaluation results are shown in Tables 1 to 3.

Evaluation Criteria for Wear Amount

A: The wear amount is very small (the relative value is less than 0.5).

B: The wear amount is small (the relative value is 0.5 or more and less than 0.75).

C: The wear amount is slightly small (the relative value is 0.75 or more and less than 1).

D: The wear amount is slightly large (the relative value is 1 or more and less than 1.25).

E: The wear amount is large (the relative value is 1.25 or more and less than 1.5).

F: The wear amount is very large (the relative value is more than 1.5).

2.8. Tensile Strength

Subsequently, with respect to each of the titanium sintered bodies of the respective Examples and Comparative Examples and each of the titanium ingot materials of the respective Reference Examples, the tensile strength was measured. The measurement of the tensile strength was performed in accordance with the metal material tensile test method specified in JIS Z 2241 (2011).

Then, the tensile strength obtained for the titanium ingot material of Reference Example 1 was taken as 1, and the relative value of the tensile strength obtained for each of the titanium sintered bodies of the respective Examples and Comparative Examples shown in Table 1 was calculated.

Similarly, the tensile strength obtained for the titanium ingot material of Reference Example 2 was taken as 1, and the relative value of the tensile strength obtained for each of the titanium sintered bodies of the respective Examples and Comparative Examples shown in Table 2 was calculated.

Further similarly, the tensile strength obtained for the titanium ingot material of Reference Example 3 was taken as 1, and the relative value of the tensile strength obtained for each of the titanium sintered bodies of the respective Examples and Comparative Examples shown in Table 3 was calculated.

Then, the obtained relative value was evaluated according to the following evaluation criteria. The evaluation results are shown in Tables 1 to 3. As for the tensile strength, other than the above-mentioned test specimens, also an SUS316L sintered body, a cast material and a sintered body of ASTM F75 (a CO-28% Cr-6% Mo alloy), and an α-Ti sintered body were evaluated as Reference Examples a to d (Table 1). Further, with respect to Reference Example d, the same evaluation as in the above-mentioned 2.1., 2.2, and 2.5. to 2.7 was performed in addition to the tensile strength.

Evaluation Criteria for Tensile Strength

A: The tensile strength is very large (the relative value is 1.09 or more).

B: The tensile strength is large (the relative value is 1.06 or more and less than 1.09).

C: The tensile strength is slightly large (the relative value is 1.3 or more and less than 1.06).

D: The tensile strength is slightly small (the relative value is 1 or more and less than 1.03).

E: The tensile strength is small (the relative value is 0.97 or more and less than 1).

F: The tensile strength is very small (the relative value is less than 0.97).

2.9. Nominal Strain at Break (Elongation at Break)

Subsequently, with respect to each of the titanium sintered bodies of the respective Examples and Comparative Examples and each of the titanium ingot materials and the like of the respective Reference Examples, the elongation at break was measured. The measurement of the elongation at break was performed in accordance with the metal material tensile test method specified in JIS Z 2241 (2011).

Then, the obtained elongation at break was evaluated according to the following evaluation criteria. The evaluation results are shown in Tables 1 to 3. As for the elongation at break, other than the above-mentioned test specimens, also an SUS316L sintered body, a cast material and a sintered body of ASTM F75 (a CO-28% Cr-6% Mo alloy), and an α-Ti sintered body were evaluated as Reference Examples a to d (Table 1).

Evaluation Criteria for Elongation at Break

A: The elongation at break is very large (0.15 or more).

B: The elongation at break is large (0.125 or more and less than 0.15).

C: The elongation at break is slightly large (0.10 or more and less than 0.125).

D: The elongation at break is slightly small (0.075 or more and less than 0.10).

E: The elongation at break is small (0.050 or more and less than 0.075).

F: The elongation at break is very small (less than 0.050).

2.10. Cytotoxicity Test

Subsequently, with respect to a test specimen composed of each of the titanium sintered bodies of the respective Examples and Comparative Examples and each of the titanium ingot materials and the like of the respective Reference Examples, a cytotoxicity test was performed. The cytotoxicity test was performed in accordance with the cytotoxicity test specified in ISO 10993-5:2009. Specifically, by a colony formation method using a direct contact method, an average of the number of colonies in a control group is taken as 100%, and the ratio of the number of colonies of cells directly inoculated onto the test specimen to the number of colonies in the control group (colony formation ratio (%)) was obtained. The test conditions were as follows.

Cell line: V97 cell line

Culture medium: MEM10 medium

Negative control material (negative control): high-density polyethylene film

Positive control material (positive control): 0.1% zinc diethyldithiocarbamate-containing polyurethane film Control group (control): the number of colonies of cells directly inoculated into the culture medium Subsequently, the obtained colony formation ratio was classified according to the following evaluation criteria, whereby the cytotoxicity of each test specimen was evaluated. The evaluation results are shown in Tables 1 to 3. As for the cytotoxicity test, other than the above-mentioned test specimens, also an SUS316L sintered body, a sintered body of ASTM F75 (a CO-28% Cr-6% Mo alloy), and an α-Ti sintered body were evaluated as Reference Examples a, c, and d (Table 1).

Evaluation Criteria for Cytotoxicity

A: The colony formation ratio is 90% or more.

B: The colony formation ratio is 80% or more and less than 90%.

C: The colony formation ratio is less than 80%.

TABLE 1

| | | | Structure of titanium sintered body | | | | | | |
|---|---|---|---|---|---|---|---|---|---|
| | | | | α-phase | | | | | |
| | Production method — | Composition — | Crystal structure — | Average grain size μm | Area ratio % | Aspect ratio — | β-phase Area ratio % | Oxygen content ppm | Vickers hardness — |
| Example 1 | Sintered body | Ti-6Al-4V | α + β | 15 | 82 | 1.8 | 18 | 3750 | 380 |
| Example 2 | Sintered body | Ti-6Al-4V | α + β | 12 | 88 | 1.6 | 12 | 4250 | 395 |
| Example 3 | Sintered body | Ti-6Al-4V | α + β | 24 | 78 | 2.2 | 22 | 3200 | 360 |
| Example 4 | Sintered body | Ti-6Al-4V | α + β | 8 | 92 | 1.3 | 8 | 4600 | 410 |
| Example 5 | Sintered body | Ti-6Al-4V | α + β | 28 | 72 | 2.5 | 28 | 2800 | 340 |
| Example 6 | Sintered body | Ti-6Al-4V | α + β | 5 | 85 | 1.9 | 15 | 5100 | 425 |
| Comparative Example 1 | Sintered body | Ti-6Al-4V | α + β | 2 | 77 | 1.4 | 23 | 5800 | 400 |
| Comparative Example 2 | Sintered body | Ti-6Al-4V | α + β | 35 | 71 | 4.5 | 29 | 2600 | 230 |
| Comparative Example 3 | Sintered body | Ti-6Al-4V | α + β | 27 | 66 | 7.6 | 34 | 2100 | 240 |
| Comparative Example 4 | Sintered body | Ti-6Al-4V | α + β | 2 | 54 | 1.8 | 46 | 9800 | 600 |
| Reference Example 1 | Ingot material | Ti-6Al-4V | α + β | 4 | 90 | 3.1 | 10 | 400 | 350 |
| Reference Example a | Sintered body | SUS316L | — | — | — | — | — | — | — |
| Reference Example b | Cast material | F75 | — | — | — | — | — | — | — |

TABLE 1-continued

| | | | | | | | | | |
|---|---|---|---|---|---|---|---|---|---|
| Reference Example c | Sintered body | F75 | — | — | — | — | — | — | — |
| Reference Example d | Sintered body | α-Ti | α | 5 | 99.9 | 2.4 | 0.1 | 1400 | 210 |
| Negative control material | | | | | | | | | |
| Positive control material | | | | | | | | | |

| | Structure of titanium sintered body | | Evaluation results | | | | | |
|---|---|---|---|---|---|---|---|---|
| | Average particle diameter of titanium oxide particles μm | X-ray diffraction peak ratio % | Specularity — | Relative density % | Wear resistance — | Tensile strength — | Elongation at break — | Cytotoxicity test — |
| Example 1 | 3.5 | 28 | A | 99.8 | A | A | B | B |
| Example 2 | 7.8 | 22 | A | 99.7 | A | A | B | B |
| Example 3 | 2.4 | 32 | A | 99.5 | B | B | B | B |
| Example 4 | 9.4 | 18 | A | 99.6 | B | B | B | B |
| Example 5 | 1.8 | 38 | B | 99.3 | C | C | B | B |
| Example 6 | 14.6 | 25 | B | 99.1 | B | C | B | B |
| Comparative Example 1 | 22.3 | 33 | C | 98.5 | D | D | C | B |
| Comparative Example 2 | 0.9 | 51 | D | 96.4 | D | E | C | B |
| Comparative Example 3 | 0.4 | 63 | D | 97.2 | D | E | C | B |
| Comparative Example 4 | 32.0 | — | D | 93.5 | E | F | D | B |
| Reference Example 1 | 0.0 | 20 | B | 99.8 | D | C | C | B |
| Reference Example a | — | — | — | — | — | F | A | A |
| Reference Example b | — | — | — | — | — | C | C | — |
| Reference Example c | — | — | — | — | — | D | D | B |
| Reference Example d | — | — | D | 96.5 | E | E | E | B |
| Negative control material | | | | | — | | | A |
| Positive control material | | | | | — | | | C |

TABLE 2

| | | Structure of titanium sintered body | | | | | | | |
|---|---|---|---|---|---|---|---|---|---|
| | | | | α-phase | | | β-phase | | |
| | Production method — | Composition — | Crystal structure — | Average grain size μm | Area ratio % | Aspect ratio — | Area ratio % | Oxygen content ppm | Vickers hardness — |
| Example 7 | Sintered body | Ti-3Al-2.5V | α + β | 18 | 83 | 2.0 | 17 | 3600 | 370 |
| Example 8 | Sintered body | Ti-3Al-2.5V | α + β | 11 | 89 | 1.7 | 11 | 4400 | 380 |
| Example 9 | Sintered body | Ti-3Al-2.5V | α + β | 25 | 79 | 2.3 | 21 | 3000 | 350 |
| Example 10 | Sintered body | Ti-3Al-2.5V | α + β | 9 | 93 | 1.4 | 7 | 4700 | 400 |
| Example 11 | Sintered body | Ti-3Al-2.5V | α + β | 27 | 73 | 2.6 | 27 | 2600 | 330 |
| Example 12 | Sintered body | Ti-3Al-2.5V | α + β | 6 | 84 | 2.3 | 16 | 5300 | 415 |
| Comparative Example 5 | Sintered body | Ti-3Al-2.5V | α + β | 2 | 75 | 1.7 | 25 | 6000 | 390 |
| Comparative Example 6 | Sintered body | Ti-3Al-2.5V | α + β | 36 | 72 | 4.8 | 28 | 2700 | 220 |
| Comparative Example 7 | Sintered body | Ti-3Al-2.5V | α + β | 28 | 68 | 8.2 | 32 | 1800 | 230 |
| Comparative Example 8 | Sintered body | Ti-3Al-2.5V | α + β | 2 | 48 | 2.5 | 52 | 9600 | 580 |
| Reference Example 2 | Ingot material | Ti-3Al-2.5V | α + β | 3 | 91 | 3.2 | 9 | 500 | 340 |

TABLE 2-continued

| | Structure of titanium sintered body | | Evaluation results | | | | | |
|---|---|---|---|---|---|---|---|---|
| | Average particle diameter of titanium oxide particles μm | X-ray diffraction peak ratio % | Specularity — | Relative density % | Wear resistance — | Tensile strength — | Elongation at break — | Cytotoxicity test — |
| Example 7 | 2.8 | 27 | A | 99.8 | A | A | B | B |
| Example 8 | 8.6 | 21 | A | 99.7 | A | A | B | B |
| Example 9 | 2.2 | 31 | A | 99.5 | A | B | B | B |
| Example 10 | 11.4 | 17 | A | 99.4 | B | B | B | B |
| Example 11 | 1.5 | 37 | B | 99.2 | C | C | B | B |
| Example 12 | 16.5 | 26 | B | 99.1 | B | C | B | B |
| Comparative Example 5 | 23.5 | 35 | C | 98.6 | D | D | C | B |
| Comparative Example 6 | 0.8 | 52 | D | 96.5 | D | E | C | B |
| Comparative Example 7 | 0.3 | 64 | D | 97.8 | D | E | C | B |
| Comparative Example 8 | 28.7 | — | D | 93.8 | E | F | D | B |
| Reference Example 2 | 0.0 | 19 | B | 99.7 | D | C | C | B |

TABLE 3

| | | Structure of titanium sintered body | | | | | | | |
|---|---|---|---|---|---|---|---|---|---|
| | | | | α-phase | | | | | |
| | Production method — | Composition — | Crystal structure — | Average grain size μm | Area ratio % | Aspect ratio — | β-phase Area ratio % | Oxygen content ppm | Vickers hardness — |
| Example 13 | Sintered body | Ti-6Al-7Nb | α + β | 13 | 90 | 1.9 | 10 | 3500 | 390 |
| Example 14 | Sintered body | Ti-6Al-7Nb | α + β | 9 | 96 | 1.5 | 4 | 4500 | 400 |
| Example 15 | Sintered body | Ti-6Al-7Nb | α + β | 22 | 80 | 2.1 | 20 | 3100 | 360 |
| Example 16 | Sintered body | Ti-6Al-7Nb | α + β | 7 | 98 | 1.3 | 2 | 4800 | 420 |
| Example 17 | Sintered body | Ti-6Al-7Nb | α + β | 25 | 78 | 2.2 | 22 | 2550 | 340 |
| Example 18 | Sintered body | Ti-6Al-7Nb | α + β | 5 | 92 | 1.8 | 8 | 5400 | 440 |
| Comparative Example 9 | Sintered body | Ti-6Al-7Nb | α + β | 2 | 76 | 1.6 | 24 | 6200 | 410 |
| Comparative Example 10 | Sintered body | Ti-6Al-7Nb | α + β | 37 | 71 | 4.9 | 29 | 2800 | 210 |
| Comparative Example 11 | Sintered body | Ti-6Al-7Nb | α + β | 29 | 65 | 7.8 | 35 | 2000 | 220 |
| Comparative Example 12 | Sintered body | Ti-6Al-7Nb | α + β | 2 | 50 | 2.3 | 50 | 8500 | 620 |
| Reference Example 3 | Ingot material | Ti-6Al-7Nb | α + β | 4 | 93 | 3.5 | 7 | 600 | 330 |

| | Structure of titanium sintered body | | Evaluation results | | | | | |
|---|---|---|---|---|---|---|---|---|
| | Average particle diameter of titanium oxide particles μm | X-ray diffraction peak ratio % | Specularity — | Relative density % | Wear resistance — | Tensile strength — | Elongation at break — | Cytotoxicity test — |
| Example 13 | 4.6 | 20 | A | 99.7 | A | A | B | A |
| Example 14 | 9.2 | 14 | A | 99.8 | A | A | B | A |
| Example 15 | 3.4 | 30 | A | 99.3 | B | B | B | A |
| Example 16 | 12.6 | 12 | A | 99.5 | A | B | B | A |

TABLE 3-continued

| | | | | | | | | |
|---|---|---|---|---|---|---|---|---|
| Example 17 | 1.2 | 32 | B | 99.0 | C | C | B | A |
| Example 18 | 18.7 | 18 | B | 99.2 | B | C | B | A |
| Comparative Example 9 | 25.5 | 34 | C | 98.4 | D | D | C | A |
| Comparative Example 10 | 0.8 | 53 | D | 96.6 | D | E | C | A |
| Comparative Example 11 | 0.2 | 65 | D | 97.6 | D | E | C | A |
| Comparative Example 12 | 30.2 | — | D | 94.2 | E | F | D | A |
| Reference Example 3 | 0.0 | 17 | B | 99.5 | D | B | C | A |

As apparent from Tables 1 to 3, it was confirmed that each of the titanium sintered bodies of the respective Examples has excellent wear resistance. It was also confirmed that each of the titanium sintered bodies of the respective Examples has a high relative density and a high tensile strength, and also has excellent specularity on the polished surface.

Figure 11:
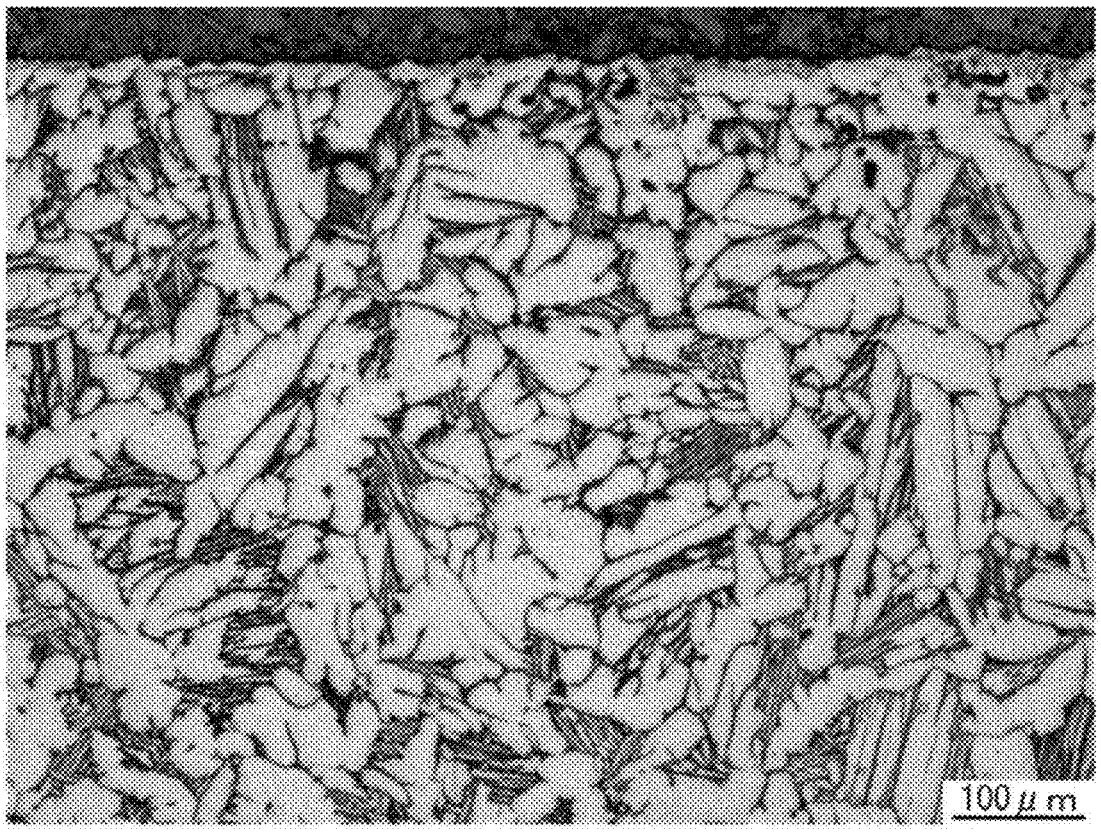
FIG. 11 is an electron microscopic image of a cross section of a titanium sintered body of Comparative Example 2.

An electron microscopic image of a cross section of the titanium sintered body of Comparative Example 2 is shown in FIG. 11. From FIG. 11, it is confirmed that in the titanium sintered body of Comparative Example 2, the α-phase has an elongated shape, that is, a highly anisotropic shape.

Figure 12:
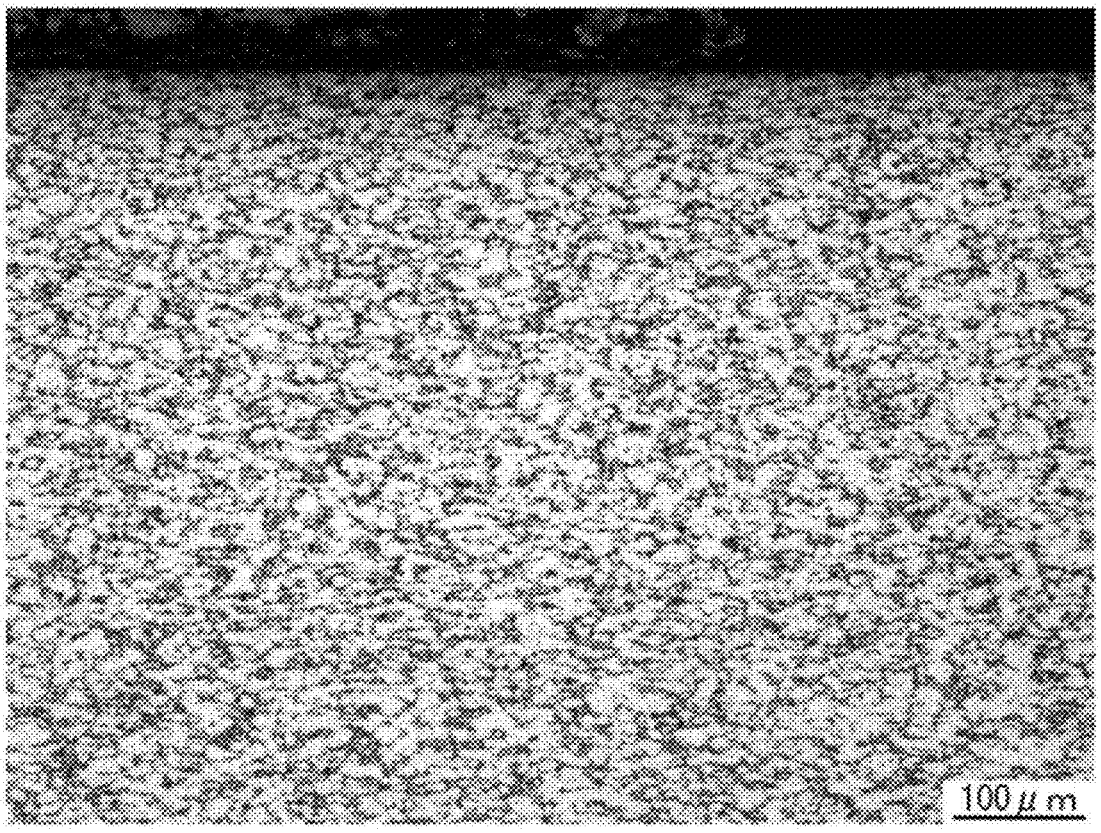
FIG. 12 is an electron microscopic image of a cross section of a titanium ingot material of Reference Example 1.

Further, an electron microscopic image of a cross section of the titanium ingot material of Reference Example 1 is shown in FIG. 12. From FIG. 12, it is confirmed that in the titanium ingot material of Reference Example 1, although the grain size of the α-phase is relatively small, the α-phase has a highly anisotropic shape.

What is claimed is:

1. A titanium sintered body, comprising a material containing titanium and gallium, wherein an oxygen content in the titanium sintered body is 3500 ppm by mass or more and 3750 ppm by mass or less, the titanium sintered body contains an α-phase and a β-phase as crystal structures, in a cross-section of the titanium sintered body, an area ratio occupied by the α-phase is 70% or more and 99.8% or less as a result of the titanium sintered body being sintered in an atmosphere that is composed of either argon or nitrogen, and a surface Vickers hardness is 250 or more and 500 or less.

2. The titanium sintered body according to claim 1, wherein in an X-ray diffraction spectrum obtained by X-ray diffractometry, the value of a peak reflection intensity by the plane orientation (110) of the β-phase is 5% or more and 60% or less of the value of a peak reflection intensity by the plane orientation (100) of the α-phase.

3. The titanium sintered body according to claim 1, wherein particles composed mainly of titanium oxide are included.

4. The titanium sintered body according to claim 1, wherein a relative density is 99% or more.

5. An ornament comprising the titanium sintered body according to claim 1.

6. An ornament comprising the titanium sintered body according to claim 2.

7. An ornament comprising the titanium sintered body according to claim 3.

8. An ornament comprising the titanium sintered body according to claim 4.

9. A heat resistant component comprising the titanium sintered body according to claim 1.

* * * * *